US012768274B2

(12) United States Patent
Yonezawa

(10) Patent No.: US 12,768,274 B2
(45) Date of Patent: Oct. 20, 2026

(54) ROTOR BLADE

(71) Applicant: MEGADERU INC., Tokyo (JP)

(72) Inventor: Tomonori Yonezawa, Setagaya Tokyo (JP)

(73) Assignee: MEGADERU INC., Tokyo (JP)

( * ) Notice: Subject to any disclaimer, the term of this patent is extended or adjusted under 35 U.S.C. 154(b) by 0 days.

(21) Appl. No.: 19/112,084

(22) PCT Filed: Aug. 30, 2023

(86) PCT No.: PCT/JP2023/031651
§ 371 (c)(1),
(2) Date: Mar. 14, 2025

(87) PCT Pub. No.: WO2024/057935
PCT Pub. Date: Mar. 21, 2024

(65) Prior Publication Data

US 2025/0382879 A1 Dec. 18, 2025

(30) Foreign Application Priority Data

Sep. 16, 2022 (JP) ..... 2022-148646
Apr. 27, 2023 (JP) ..... 2023-073884
May 26, 2023 (JP) ..... 2023-086566

(51) Int. Cl.
*F01D 5/02* (2006.01)
*F01D 5/14* (2006.01)
(Continued)

(52) U.S. Cl.
CPC ..... *F01D 5/02* (2013.01); *F01D 5/141* (2013.01); *F04D 29/24* (2013.01); *F04D 29/281* (2013.01);
(Continued)

(58) Field of Classification Search
CPC . F03D 1/06; F03D 1/0633; F03D 3/06; F03D 3/061; F03D 3/062; F04D 29/384;
(Continued)

(56) References Cited

U.S. PATENT DOCUMENTS 4,218,175 A * 8/1980 Carpenter ..... F03D 1/04 415/75
D368,886 S * 4/1996 Kuryliw ..... D12/214
(Continued)

FOREIGN PATENT DOCUMENTS

JP 2008-240564 A 10/2008
JP 2009-113662 A 5/2009
(Continued)

OTHER PUBLICATIONS

Translation of International Preliminary Report on Patentability dated Mar. 1, 2025, mailed in counterpart International Application No. PCT/JP2023/031651, 6 pages.
(Continued)

*Primary Examiner* — Courtney D Heinle
*Assistant Examiner* — Behnoush Haghighian
(74) *Attorney, Agent, or Firm* — Kim & Stewart LLP

(57) ABSTRACT

A rotor includes a hub on a rotation axis of the rotor, a plurality of blades each connected to and curved around the hub, and a plurality of reinforcing portions each curved around the hub and connected to at least one of a front edge portion or a rear edge portion of the blades adjacent to one another in at least a radial direction.

8 Claims, 29 Drawing Sheets

(51) Int. Cl.
*F04D 29/24* (2006.01)
*F04D 29/28* (2006.01)
*F04D 29/30* (2006.01)
*F04D 29/32* (2006.01)
*F04D 29/38* (2006.01)

(52) U.S. Cl.
CPC ..... *F04D 29/30* (2013.01); *F04D 29/325* (2013.01); *F04D 29/329* (2013.01); *F04D 29/384* (2013.01)

(58) Field of Classification Search
CPC ..... F04D 29/24; F04D 29/30; F04D 29/32; F04D 29/329; F04D 29/28; F04D 29/281; F04D 29/388; F04D 29/325; F04D 29/668; F04D 29/2216; F04D 29/2238; F04D 29/2244; F01D 5/147; F01D 5/141; F01D 5/02; B64C 11/18; B64C 11/20; B64C 27/473
See application file for complete search history.

(56) References Cited

U.S. PATENT DOCUMENTS 6,382,915 B1 * 5/2002 Aschermann ..... F04D 25/022 416/169 A
8,240,996 B2 * 8/2012 Surls ..... F04D 29/325 416/169 A
8,556,587 B2 * 10/2013 Suzuki ..... B29C 33/44 416/193 R
8,647,051 B2 * 2/2014 O'Connor ..... F04D 29/329 415/206
8,905,706 B2 * 12/2014 Bills ..... F03D 1/0633 416/223 R
8,961,107 B2 * 2/2015 Su ..... F04D 29/30 415/206
11,401,943 B2 * 8/2022 Horng ..... F04D 29/34
2007/0065279 A1 * 3/2007 Lin ..... F04D 29/281 415/206
2008/0226446 A1 * 9/2008 Fujieda ..... F04D 29/281 415/203
2010/0092297 A1 * 4/2010 Surls ..... F04D 29/329 416/204 R
2010/0260608 A1 * 10/2010 Suzuki ..... F04D 29/34 416/204 R
2011/0014052 A1 * 1/2011 Hoskins ..... F04D 29/325 416/212 R
2011/0064570 A1 * 3/2011 O'Connor ..... F04D 29/30 415/203
2011/0255975 A1 * 10/2011 Perless ..... F03D 3/061 416/176
2011/0311363 A1 * 12/2011 Bills ..... F03D 1/0633 416/176
2011/0311636 A1 12/2011 Tidmarsh et al.
2012/0183407 A1 * 7/2012 Vallejo ..... F03D 3/064 416/228
2021/0047931 A1 * 2/2021 Horng ..... F04D 29/281

FOREIGN PATENT DOCUMENTS

JP 2009-257260 A 11/2009
JP 2010-526960 A 8/2010
JP 2018-91281 A 6/2018
WO 2011/142653 A1 11/2011
WO 2017/082489 A1 5/2017

OTHER PUBLICATIONS

Notice of Reasons for Refusal dated Oct. 30, 2024, in corresponding Japanese Application No. 2024-545083, 10 pages (with machine translation).
Notice of Reasons for Refusal dated Feb. 20, 2025, n corresponding Japanese Application No. 2024-545083, 12 pages (with machine translation).
International Search Report dated mailed Oct. 31, 2023 in counterpart International Application No. PCT/JP2023/031651, 2 pages.

* cited by examiner

ROTOR BLADE

CROSS-REFERENCE TO RELATED APPLICATIONS

This application is a 35 U.S.C. § 371 national phase application of PCT/JP2023/031651, filed on Aug. 30, 2023, which claims priority to Japanese Patent Application No. 2022-148646, filed on Sep. 16, 2022, Japanese Patent Application No. 2023-073884, filed on Apr. 27, 2023, and Japanese Patent Application No. 2023-086566, filed on May 26, 2023, the entire contents of which are incorporated herein by reference.

TECHNICAL FIELD

The present invention relates to a rotor blade.

BACKGROUND ART

Natural energy is used to rotate a rotor blade and generate electricity from the rotation, and conversely, electric power is used to rotate a rotor blade to create a flow.

Patent Document 1 discloses in claim 1 and FIG. 4A to FIG. 5 that regarding a rotor blade unit of a wind turbine, a rotor blade has a spiral shape around a central axis and extends along the central axis. Patent Document 2 discloses, in paragraph 0056 and FIG. 1A to FIG. 2C, a funnel-shaped propeller in which each propeller blade is configured to be spiral-shaped or vortex-shaped with a central axis at a center. Patent Document 3 discloses in paragraphs 0004, 0006, and 0014 and FIG. 1 that regarding a horizontal shaft rotor, in order to allow fluid moving in a blade tip direction of a blade to pass in a rotational rear direction of the blade without letting it outside a rotating diameter of the blade, the blade is flexed greatly from a middle to the blade tip in the rotational rear direction to enhance rotational efficiency. On the other hand, Patent Document 4 discloses in FIG. 1 that regarding a cooling fan, a second ring concentric with a boss is disposed between a first ring of a blade and the boss, thereby increasing rigidity between the first ring of the blade and the boss.

RELATED ART DOCUMENT

Patent Literature

Patent Document 1: Japanese Translation of PCT International Application Publication No. JP-T-2013-526671

Patent Document 2: U.S. Patent Application Publication No. 2011/0311363

Patent Document 3: Japanese Unexamined Patent Application Publication No. 2018-91281

Patent Document 4: Japanese Unexamined Patent Application Publication No. 2008-240564

SUMMARY OF INVENTION

Technical Problem

As disclosed in Patent Documents 1 to 3, curved vanes or blades are considered. While some of them have been put to practical use, there is a problem that the vanes or blades are easily deformed.

Therefore, an object of the present invention is to provide a rotor blade in which a plurality of blades curved and connected to a hub are difficult to deform due to fluid.

Solution to Problem

The above-described object is achieved by the following concepts.

A rotor blade according to a first concept of the present invention includes:

a hub;

a plurality of blades, each having one end connected to the hub and disposed to be curved around the hub; and a plurality of reinforcing portions, each of the plurality of reinforcing portions disposed between the blades adjacent to one another in at least a radial direction on at least any of a one-direction side along a rotation axis of the hub or an opposite-direction side, each of the plurality of reinforcing portions having a straight line shape, each of the plurality of reinforcing portions disposed between the blades adjacent to one another in a radial direction, each of the plurality of reinforcing portions having an axial distance of ½ or less in dimension of a radial distance, or each of the plurality of reinforcing portions being curved, whereby the plurality of reinforcing portions prevent the plurality of blades from being deformed.

In a rotor blade according to a second concept of the present invention, which is in the first concept of the present invention, each of the plurality of blades is curved in a first direction around a rotation axis of the hub when viewed from the one-direction side, each of the plurality of reinforcing portions is curved in a second direction around the rotation axis of the hub when viewed from the one-direction side, and the first direction is opposite to the second direction.

In a rotor blade according to a third concept of the present invention, which is in the first concept of the present invention, each of the plurality of reinforcing portions is connected to each of the plurality of blades at one or a plurality of positions.

In a rotor blade according to a fourth concept of the present invention, which is in the third concept of the present invention, each of the plurality of reinforcing portions is connected to any of the plurality of blades at a position most distant from the hub.

In a rotor blade according to a fifth concept of the present invention, which is in the first concept of the present invention, on the plurality of blades on at least any of the one-direction side or the opposite direction side where each of the plurality of reinforcing portions is attached, an endless-shaped ring portion is disposed to extend across the plurality of blades.

In a rotor blade according to a sixth concept of the present invention, which is in the fifth concept of the present invention, a part on a base end side of each of the plurality of reinforcing portions is connected to the ring portion.

In a rotor blade according to a seventh concept of the present invention, which is in the first concept of the present invention, a part on a base end side of each of the plurality of reinforcing portions is connected to the hub.

In a rotor blade according to an eighth concept of the present invention, which is in any one of the first to seventh concepts of the present invention, each of the plurality of blades is configured to include a blade main body portion, the blade main body portion having an end on the one-direction side or an end on the opposite-direction side, the end on the one-direction side or the end on the opposite-direction side formed into any of a logarithmic spiral pattern, a Fibonacci spiral pattern, a Fermat's spiral pattern, a conical spiral pattern, or a hyperbolic spiral pattern, with the hub at a center when viewed from the one-direction side, and a width parallel to a rotation axis of the hub in the blade main body portion is uniform around the hub.

In a rotor blade according to a ninth concept of the present invention, which is in the eighth concept of the present invention, each of the plurality of blades is configured to include a distal end portion connected to the blade main body portion, and the end on the one-direction side or the end on the opposite-direction side of the distal end portion is equidistant from the hub when viewed from the one-direction side.

In a rotor blade according to a tenth concept of the present invention, which is in the first concept of the present invention, each of the plurality of blades is configured to include:

a blade main body portion, the blade main body portion having an end on the one-direction side or an end on the opposite direction side, the end on the one-direction side or the end on the opposite direction side formed into any of a logarithmic spiral pattern, a Fibonacci spiral pattern, a Fermat's spiral pattern, a conical spiral pattern, or a hyperbolic spiral pattern, with the hub at a center when viewed from the one-direction side;

an extended portion disposed on a side of the blade main body portion unconnected to the hub, the extended portion having a width parallel to a rotation axis of the hub differing around the rotation axis of the hub; and a pedestal portion disposed on any of the one-direction side or the opposite-direction side of the extended portion, wherein at least one of the plurality of reinforcing portions is connected to the pedestal portion at a position most distant from the hub.

In a rotor blade according to an eleventh concept of the present invention, which is in the tenth concept of the present invention, in the reinforcing portion, a position connected to the pedestal portion and a position connected to the blade main body portion do not shift in a rotation axis direction of the hub.

In a rotor blade according to a twelfth concept of the present invention, which is in the first concept of the present invention, each of at least two of the plurality of blades is configured to include:

a blade main body portion, the blade main body portion having an end on the one-direction side or an end on the opposite-direction side, the end on the one-direction side or the end on the opposite-direction side formed into any of a logarithmic spiral pattern, a Fibonacci spiral pattern, a Fermat's spiral pattern, a conical spiral pattern, or a hyperbolic spiral pattern, with the hub at a center when viewed from the one-direction side;

an extended portion disposed on a side of the blade main body portion unconnected to the hub, the extended portion having a width parallel to the rotation axis of the hub differing around the rotation axis of the hub; and a pedestal portion disposed on any of the one-direction side or the opposite-direction side of the extended portion, wherein at least two of the plurality of reinforcing portions are connected to the respective pedestal portions at positions most distant from the hub, and one of the pedestal portions is joined to the other pedestal portion.

Advantages Effects of Invention

The rotor blade according to the first concept of the present invention includes: a hub; a plurality of blades, each having one end connected to the hub and disposed to be curved around the hub; and a plurality of reinforcing portions, each of the plurality of reinforcing portions disposed between the blades adjacent to one another in at least a radial direction on at least any of a one-direction side along a rotation axis of the hub or an opposite-direction side, each of the plurality of reinforcing portions having a straight line shape, each of the plurality of reinforcing portions disposed between the blades adjacent to one another in a radial direction, each of the plurality of reinforcing portions having an axial distance of ½ or less in dimension of a radial distance, or each of the plurality of reinforcing portions being curved. Therefore, the plurality of blades are difficult to deform due to fluid. Here, since the plurality of blades are connected to one another by the reinforcing portions, each blade does not warp, and the shape change of curved surfaces due to centrifugal force caused by the rotation of the plurality of blades is prevented. As a result, the rigidity of the plurality of blades can be enhanced.

In the rotor blade according to the second concept of the present invention, each of the plurality of blades is curved in a first direction around a rotation axis of the hub when viewed from the one-direction side, each of the plurality of reinforcing portions is curved in a second direction around the rotation axis of the hub when viewed from the one direction side, and the first direction is opposite to the second direction. Accordingly, the reinforcing portions are disposed oppositely to a direction in which the plurality of blades deform, and the deformation of the plurality of blades is easily suppressed.

In the rotor blade according to the third concept of the present invention, each of the plurality of reinforcing portions is connected to each of the plurality of blades at one or a plurality of positions. Accordingly, the effect of self-weights of the plurality of reinforcing portions on the plurality of blades is small, and the deformation of the plurality of blades is suppressed.

In the rotor blade according to the fourth concept of the present invention, since each of the plurality of reinforcing portions is connected to any of the plurality of blades at a position most distant from the hub, the rotor blade is reinforced at the most deformable portion in each blade by the reinforcing portions.

In the rotor blade according to the fifth concept of the present invention, on the plurality of blades on at least any of the one-direction side or the opposite-direction side where each of the plurality of reinforcing portions is attached, an endless-shaped ring portion is disposed to extend across the plurality of blades. Accordingly, since the rotor blade is reinforced at a portion of each blade close to the rotation axis by the ring portion and at a portion of each blade far from the rotation axis by the reinforcing portions, it is reinforced efficiently.

In the rotor blade according to the sixth concept of the present invention, a part on a base end side of each of the plurality of reinforcing portions is connected to the ring portion. Accordingly, the part on the base end side of each of the reinforcing portions and its adjacent portion can allow force to escape in a disposing direction of the ring portion, and the rotor blade is reinforced efficiently.

In the rotor blade according to the seventh concept of the present invention, a part on a base end side of each of the plurality of reinforcing portions is connected to the hub. Accordingly, the load on the blades is reduced compared to the case where a part on the base end side of each of the plurality of reinforcing portions is connected to a blade.

In the rotor blade according to the eighth concept of the present invention, each of the plurality of blades is configured to include a blade main body portion, the blade main body portion having an end on the one-direction side or an end on the opposite-direction side, the end on the one-direction side or the end on the opposite-direction side formed into any of a logarithmic spiral pattern, a Fibonacci spiral pattern, a Fermat's spiral pattern, a conical spiral pattern, or a hyperbolic spiral pattern, with the hub at a center when viewed from the one-direction side, and a width parallel to a rotation axis of the hub in the blade main body portion is uniform around the hub. Accordingly, the rotor blade allows efficient use of space in a rotation axis direction and is effective especially when space in such a direction is restricted. Conveyance and inventory management of the rotor blade is easy.

In the rotor blade according to the ninth concept of the present invention, each of the plurality of blades is configured to include a distal end portion connected to the blade main body portion, and the end on the one-direction side or the end on the opposite direction side of the distal end portion is equidistant from the hub when viewed from the one-direction side. Therefore, it is possible to provide rotational force from fluid to the rotor blade more efficiently or to provide force from the rotor blade to fluid.

In the rotor blade according to the tenth concept of the present invention, each of the plurality of blades is configured to include: a blade main body portion, the blade main body portion having an end on the one-direction side or an end on the opposite direction side, the end on the one-direction side or the end on the opposite-direction side formed into any of a logarithmic spiral pattern, a Fibonacci spiral pattern, a Fermat's spiral pattern, a conical spiral pattern, or a hyperbolic spiral pattern, with the hub at a center when viewed from the one-direction side; an extended portion disposed on a side of the blade main body portion unconnected to the hub, the extended portion having a width parallel to a rotation axis of the hub differing around the rotation axis of the hub; and a pedestal portion disposed on any of the one-direction side or the opposite-direction side of the extended portion. At least one of the plurality of reinforcing portions is connected to the pedestal portion at a position most distant from the hub. Accordingly, the reinforcing portions are connected to the pedestal portion even on distal end sides of the blades, increasing the rigidity on the distal end sides of the blades.

In the rotor blade according to the eleventh concept of the present invention, in the reinforcing portion, a position connected to the pedestal portion and a position connected to the blade main body portion do not shift in the rotation axis direction of the hub. Therefore, the reinforcing portions are difficult to come off the blades, and rigidity becomes easier to maintain.

In the rotor blade according to the twelfth concept of the present invention, each of at least two of the plurality of blades is configured to include: a blade main body portion, the blade main body portion having an end on the one-direction side or an end on the opposite-direction side, the end on the one-direction side or the end on the opposite-direction side formed into any of a logarithmic spiral pattern, a Fibonacci spiral pattern, a Fermat's spiral pattern, a conical spiral pattern, or a hyperbolic spiral pattern, with the hub at a center when viewed from the one-direction side; an extended portion disposed on a side of the blade main body portion unconnected to the hub, the extended portion having a width parallel to the rotation axis of the hub differing around the rotation axis of the hub; and a pedestal portion disposed on any of the one-direction side or the opposite-direction side of the extended portion. At least two of the plurality of reinforcing portions are connected to the respective pedestal portions at positions most distant from the hub. One of the pedestal portions is joined to the other pedestal portion. Accordingly, the respective pedestal portions are disposed on the two blades, and also, the pedestal portions are continuous with one another. Therefore, the extended portions of the blades are continuous with one another, and rigidity becomes easier to maintain.

As described above, with the present invention, the plurality of blades curved and connected to the hub are difficult to deform due to fluid.

DESCRIPTION OF EMBODIMENTS

Figure 1:
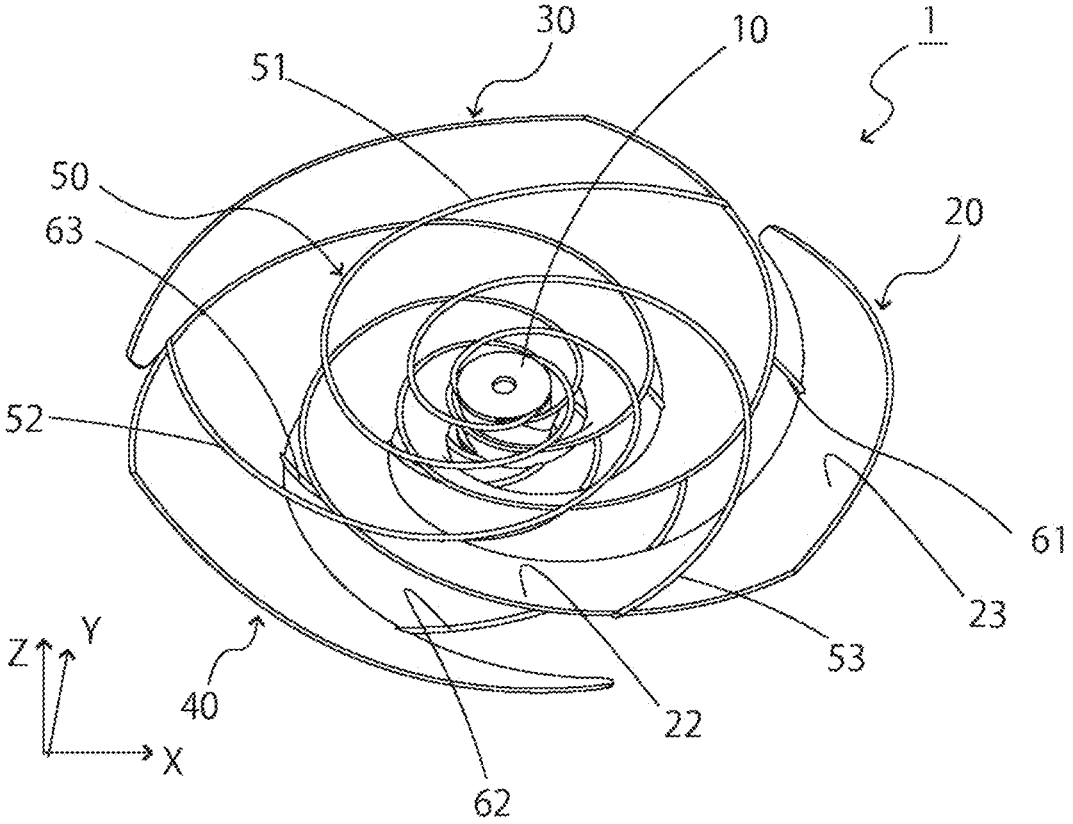
FIG. 1 is a perspective view of a rotor blade according to a first embodiment of the present invention.

The following describes embodiments of the present invention in detail by referring to the drawings. The embodiments of the present invention include forms with designs changed, for example, by changing or deleting some of constituent elements in one embodiment or replacing them with some of constituent elements in another embodiment, within the range that does not change the scope of the present invention.

First Embodiment

Figure 2A:
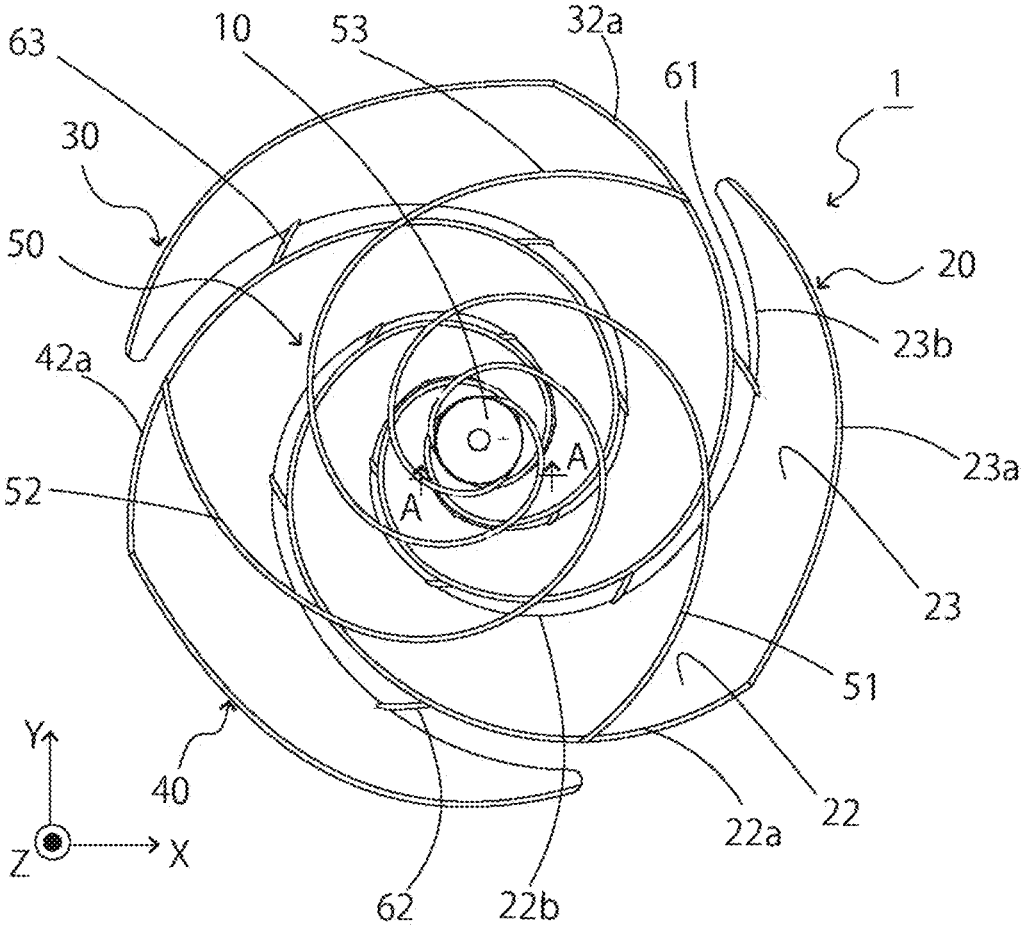
FIG. 2A is a plan view of the rotor blade illustrated in FIG. 1.
Figure 2B:
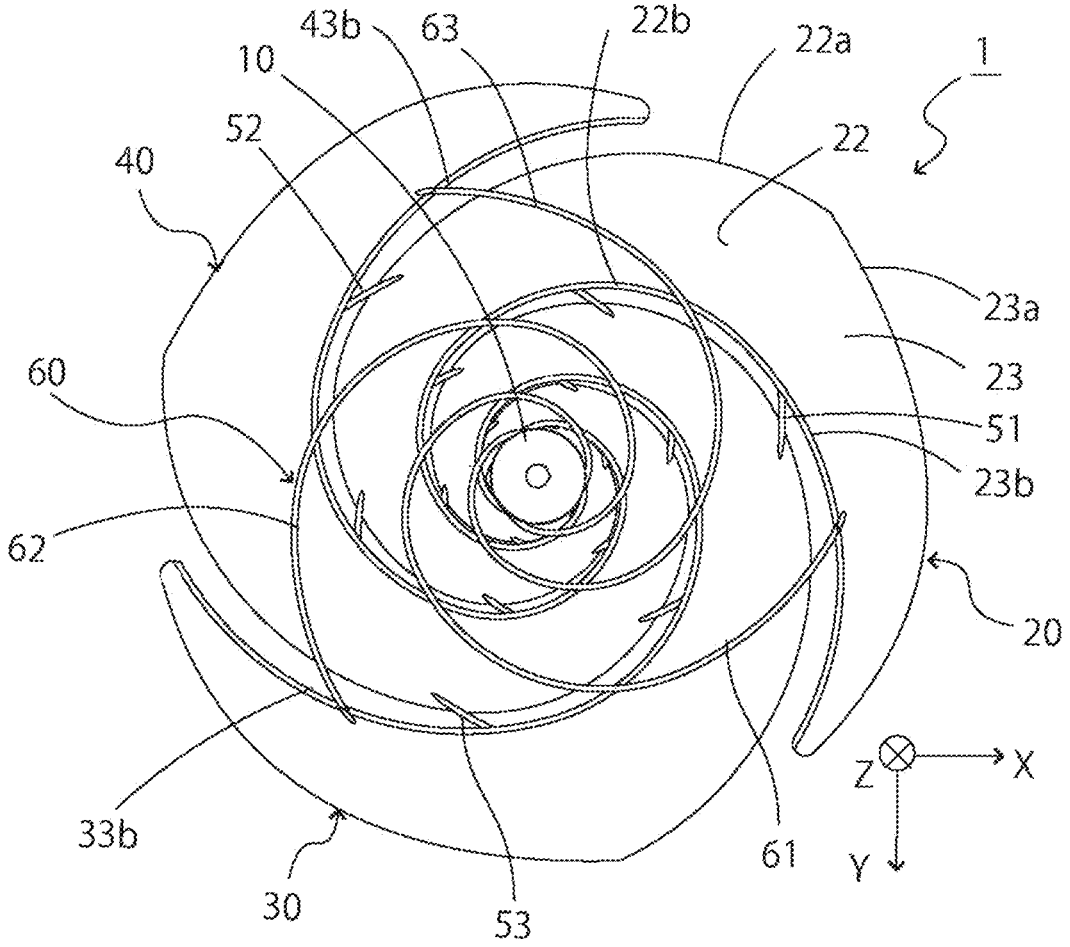
FIG. 2B is a bottom view of the rotor blade illustrated in FIG. 1.
Figure 3A:
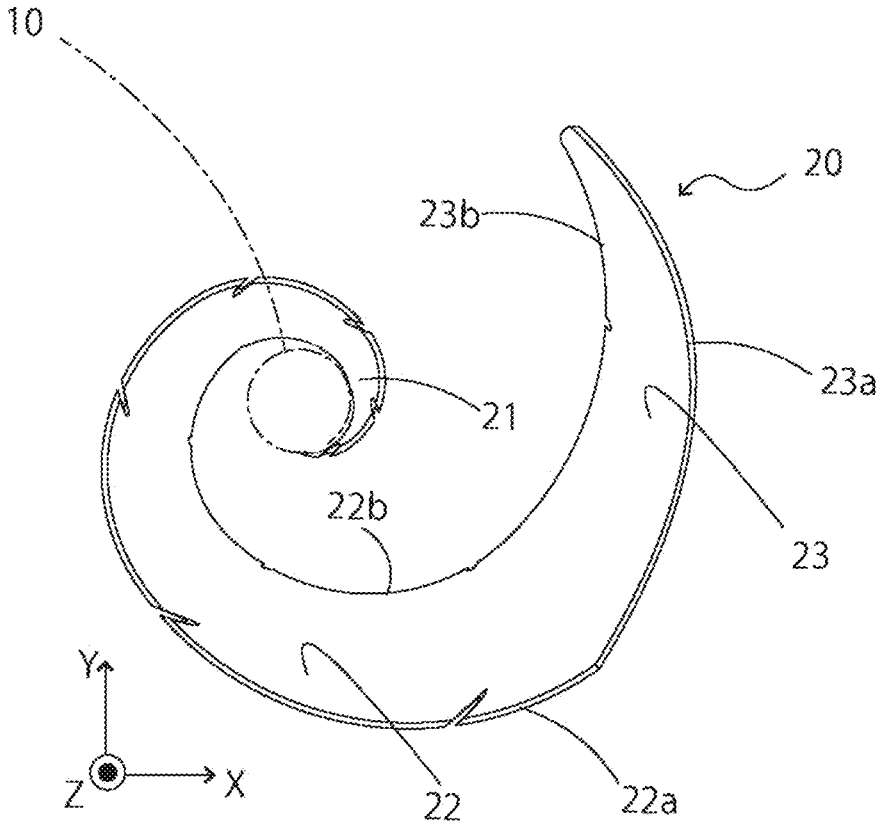
FIG. 3A is a plan view of a first blade as one blade that constitutes the rotor blade in FIG. 1.
Figure 3B:
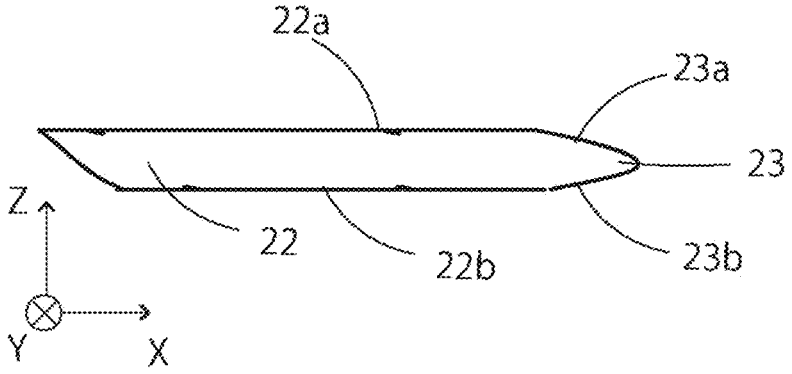
FIG. 3B is a front view of the first blade as one blade that constitutes the rotor blade in FIG. 1.
Figure 3C:
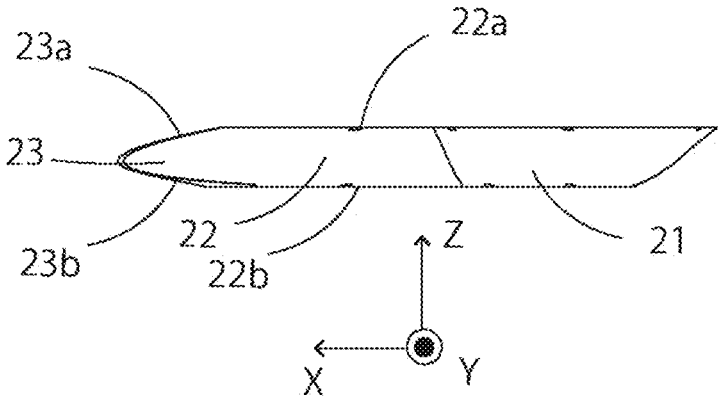
FIG. 3C is a back view of the first blade as one blade that constitutes the rotor blade in FIG. 1.
Figure 3D:
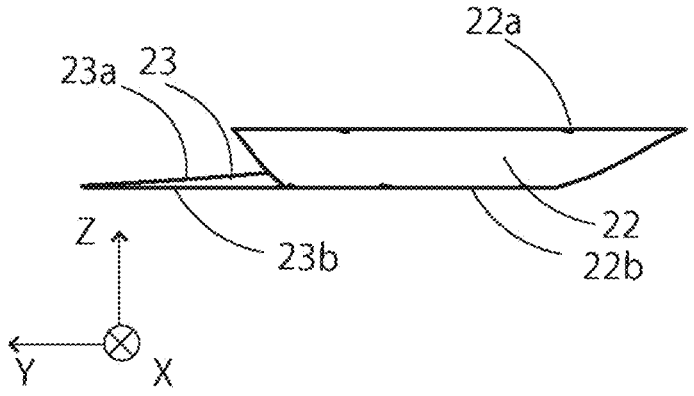
FIG. 3D is a left side view of the first blade as one blade that constitutes the rotor blade in FIG. 1.
Figure 3E:
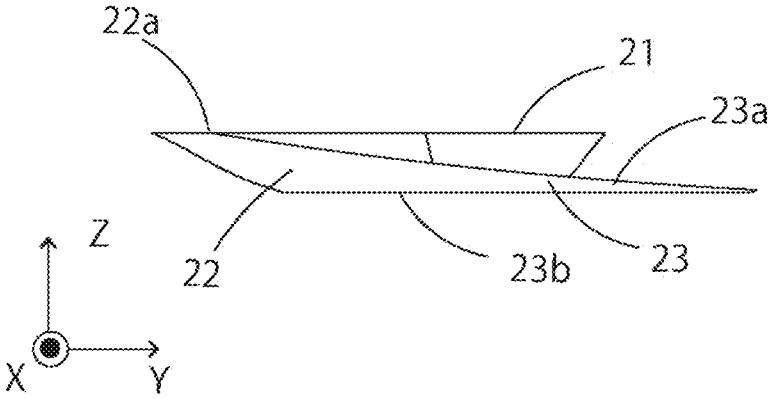
FIG. 3E is a right side view of the first blade as one blade that constitutes the rotor blade in FIG. 1.

FIG. 1 illustrates a perspective view of a rotor blade according to a first embodiment of the present invention. FIG. 2A illustrates a plan view of the rotor blade illustrated in FIG. 1. FIG. 2B illustrates a bottom view of the rotor blade illustrated in FIG. 1.

A rotor blade 1 according to the first embodiment of the present invention is configured to include a hub 10, a first blade 20, a second blade 30, and a third blade 40 as a plurality of blades, reinforcing portions 50, and reinforcing portions 60.

A shaft portion (not illustrated) extending in one direction is inserted into the hub 10, or the shaft portion is integrated with the hub 10. The shaft portion is connected to a power generation motor via a speed governor (not illustrated), as necessary. Rotation from the hub 10 is regulated by the speed governor and transmitted to the power generation motor, and the power generation motor generates electricity. In addition, the shaft portion is connected to a drive motor via a speed governor (not illustrated), as necessary. Rotation from the drive motor is regulated by the speed governor and transmitted to the hub 10, and the hub 10 rotates.

While the first blade 20, the second blade 30, and the third blade 40 as a plurality of blades are constituted of three blades as illustrated in FIG. 1, the number of blades may be two, four, or others.

FIGS. 3A, 3B, 3C, 3D, and 3E illustrate in sequence a plan view, a front view, a back view, a left side view, and a right side view of the first blade 20 as one blade that constitutes the rotor blade 1 in FIG. 1, respectively. As illustrated in FIGS. 3A to 3E, the first blade 20 has one end connected to the hub 10 and is disposed to be curved around the hub 10. The first blade 20 is configured as a unit by including a connecting portion 21, a blade main body portion 22, and a distal end portion 23. The connecting portion 21 is a portion where one end is twisted from the blade main body portion 22 and connected to the hub 10. The blade main body portion 22 is continuous with the connecting portion 21. An upper end 22*a* is formed in a predetermined spiral pattern when viewed from a side in one direction of the hub 10 (specifically, when a −Z-direction is viewed from a +Z-direction. A lower end 22*b* is formed in a predetermined spiral pattern closer to the hub 10 than the upper end 22*a* when viewed from the one-direction side. The blade main body portion 22 has a greater curvature at the lower end 22*b* than at the upper end 22*a*. Accordingly, among curved surfaces of the blade main body portion 22, a surface on the hub 10 side has a normal line that intersects on the one-direction side of the hub 10 (specifically on a +Z-axis). In the distal end portion 23, an upper end 23*a* is formed in an arc shape equidistant with the hub 10 at a center when viewed from a side in one direction (specifically, when the −Z-direction is viewed from the +Z-direction). A lower end 23*b* is formed in a spiral pattern on the hub 10 side with respect to the upper end 22*a* when viewed from the one-direction side. Among curved surfaces of the distal end portion 23, a surface on the hub 10 side has a normal line that intersects on the one-direction side of the hub 10 (specifically on the +Z-axis). Here, the lower end 23*b* may be formed in an arc shape equidistant with the hub 10 at the center when viewed from the one direction side (specifically, when the −Z-direction is viewed from the +Z-direction). Here, the upper end 22*a* is an end (front end) on the side in one direction, and the lower end 22*b* is an end (rear end) on a side in an opposite direction.

Any of the upper end 22*a* and the lower end 22*b* of the blade main body portion 22 is formed, as a predetermined spiral pattern, into any of a logarithmic spiral pattern, a Fibonacci spiral pattern, a Fermat's spiral pattern, a conical spiral pattern, or a hyperbolic spiral pattern, with the hub 10 at the center. The lower end 23*b* of the distal end portion 23 is smoothly joined along to the lower end 22*b* of the blade main body portion 22.

A dimension in a Z-axis direction along the hub 10 between the upper end 22*a* and the lower end 22*b* of the blade main body portion 22 is approximately the same and uniform, irrespective of a portion of an angle formed from a +X-axis direction of the blade main body portion 22 with the hub 10 at the center. That is, in the blade main body portion 22, a width parallel to a rotation axis of the hub 10 is uniform around the hub 10, and the upper end 22*a* and the lower end 22*b* in the blade main body portion 22 are approximately parallel in the front view, back view, and left and right side views.

On the other hand, a dimension in the Z-axis direction along the hub 10 between the upper end 23*a* and the lower end 23*b* of the distal end portion 23 depends on a portion of the angle formed from the +X-axis direction of the distal end portion 23 with the hub 10 at the center and gradually decreases toward a distal end. Here, the lower end 22*b* of the blade main body portion 22 and the lower end 23*b* of the distal end portion 23 exist on the same XY plane without changing to the sides in one direction (+Z-direction) and the opposite direction (−Z-direction) of the hub 10.

As illustrated, the first blade 20 has the blade main body portion 22 with an angle forming about 180 degrees around the hub 10 when viewed from the one-direction side (when the −Z-direction is viewed from the +Z-direction) or when viewed from the opposite-direction side (when the +Z-direction is viewed from the −Z-direction) and has the distal end portion 23 with an angle forming about 90 degrees around the hub 10. The angles of the blade main body portion 22 and the distal end portion 23, which are formed around the hub 10, in the first blade 20 are selected arbitrarily. As illustrated, the blade main body portion 22 does not need to go around the hub 10 for one revolution but may go around for a plurality of revolutions.

The second blade 30 and the third blade 40 have a shape similar to the first blade 20.

In the illustrated form, since the plurality of blades are three blades, which are the first blade 20, the second blade 30, and the third blade 40, they are concentrically arranged 120 degrees apart around the hub 10. In the case of any number of blades, the blades are concentrically arranged around the hub 10 to be equally spaced by shifting by a predetermined angle.

In the rotor blade 1 according to the first embodiment of the present invention, the hub 10 is fitted with the first blade 20, the second blade 30, and the third blade 40 as a plurality of blades, as described above. Therefore, the plurality of blades can rotate by receiving fluid (gas such as air, liquid such as water), or the rotation of the plurality of blades can extrude fluid from the plurality of blades.

In the rotor blade 1 according to the first embodiment of the present invention, a plurality of reinforcing portions 50 are disposed on the first blade 20, the second blade 30, and the third blade 40 as a plurality of blades on the one-direction side (+Z-direction) of the hub 10. The plurality of reinforcing portions 50 are referred to as a "first reinforcing group" and are distinguished from a plurality of reinforcing portions 60 described later. In the illustrated form, while the first reinforcing group 50 is constituted of three reinforcing portions of a first reinforcing portion 51, a second reinforcing portion 52, and a third reinforcing portion 53, the number of reinforcing portions may be two, four, or others. The first reinforcing portion 51 is disposed to be curved along a direction away from the hub 10. In the first reinforcing portion 51, a part on one end (base end) side is connected to the hub 10, and a part on the other end (distal end) side is connected to the upper end 22*a* of the first blade 20, which is positioned outermost (that is, most distant from the hub 10). The second reinforcing portion 52 and the third reinforcing portion 53 are also disposed to be curved along directions away from the hub 10. In the second reinforcing portion 52, a part on one end (base end) side is connected to the hub 10, and a part on the other end (distal end) side is connected to an upper end 42*a* of the third blade 40, which is positioned outermost (that is, most distant from the hub 10). In the third reinforcing portion 53, a part on one end (base end) side is connected to the hub 10, and a part on the other end (distal end) side is connected to an upper end 32*a* of the second blade 30, which is positioned outermost (that is, most distant from the hub 10). Here, while the parts on the other end (distal end) sides of the first reinforcing portion 51, the second reinforcing portion 52, and the third reinforcing portion 53 may be connected to the upper ends of the distal end portions of the corresponding blades, they exist on the same XY plane when they are connected to the upper ends of the blade main body portions rather than to those of the distal end portions. Therefore, their processing and the like are easy, and failures such as breakage are less likely to occur. One ends or the other ends of the first reinforcing portion 51, the second reinforcing portion 52, and the third reinforcing portion 53, depending on their cross-sectional shapes, do not interfere with projection from the plurality of blades to be connected on extended lines in directions where they are disposed.

As illustrated, each of the first reinforcing portion 51, the second reinforcing portion 52, and the third reinforcing portion 53 is connected to the respective upper ends of the first blade 20, the second blade 30, and the third blade 40, and what is more, a plurality of times. Regarding the first reinforcing portion 51, it is connected, twice per blade, to the respective upper ends of the third blade 40, the second blade 30, the first blade 20, the third blade 40, the second blade 30, and the first blade 20 in this order. By connecting a plurality of times in this way, deformation is suppressed by the action of the first reinforcing group 50, even if the plurality of blades rotate and act with fluid.

In the rotor blade 1 according to the first embodiment of the present invention, a plurality of reinforcing portions 60 are disposed on the first blade 20, the second blade 30, and the third blade 40 as a plurality of blades on the opposite-direction side (−Z-direction) of the hub 10. The plurality of reinforcing portions 60 are referred to as a "second reinforcing group" and are distinguished from the plurality of reinforcing portions 50 described above. In the illustrated form, while the second reinforcing group 60 is constituted of three reinforcing portions of a first reinforcing portion 61, a second reinforcing portion 62, and a third reinforcing portion 63, the number of reinforcing portions may be two, four, or others. The first reinforcing portion 61 is disposed to be curved along a direction away from the hub 10. In the first reinforcing portion 61, a part on one end (base end) side is connected to the hub 10, and a part on the other end (distal end) side is connected to the lower end 23*b* of the first blade 20, which is positioned outermost (that is, most distant from the hub 10). The second reinforcing portion 62 and the third reinforcing portion 63 are also disposed to be curved along directions away from the hub 10. In the second reinforcing portion 62, a part on one end (base end) side is connected to the hub 10, and a part on the other end (distal end) side is connected to a lower end 33*b* of the second blade 30, which is positioned outermost (that is, most distant from the hub 10). In the third reinforcing portion 63, a part on one end (base end) side is connected to the hub 10, and a part on the other end (distal end) side is connected to a lower end 43*b* of the third blade 40, which is positioned outermost (that is, most distant from the hub 10). Here, the parts on the other end (distal end) sides of the first reinforcing portion 61, the second reinforcing portion 62, and the third reinforcing portion 63 may be connected to the lower ends of the distal end portions of the corresponding blades. However, their reinforcement becomes greater when the parts are connected to the lower ends of the distal end portions than when they are connected to the lower ends of the blade main body portions.

In the rotor blade 1 according to the first embodiment of the present invention, the first reinforcing group 50 and the second reinforcing group 60 are disposed on the one direction side and the opposite direction side, respectively. The direction of curvature in the first reinforcing group 50 and the second reinforcing group 60 is opposite to the direction of curvature of the first blade 20, the second blade 30, and the third blade 40. Accordingly, the first reinforcing group 50 and the second reinforcing group 60 are disposed oppositely to a direction where the first blade 20, the second blade 30, and the third blade 40 deform. Therefore, the deformation of the first blade 20, the second blade 30, and the third blade 40 as a plurality of blades is easily suppressed. The first reinforcing portion 61, the second reinforcing portion 62, and the third reinforcing portion 63 constituting the second reinforcing group 60 have a curvature nearly equal to that of the first reinforcing portion 51, the second reinforcing portion 52, and the third reinforcing portion 53 constituting the first reinforcing group 50.

Second Embodiment

Figure 4:
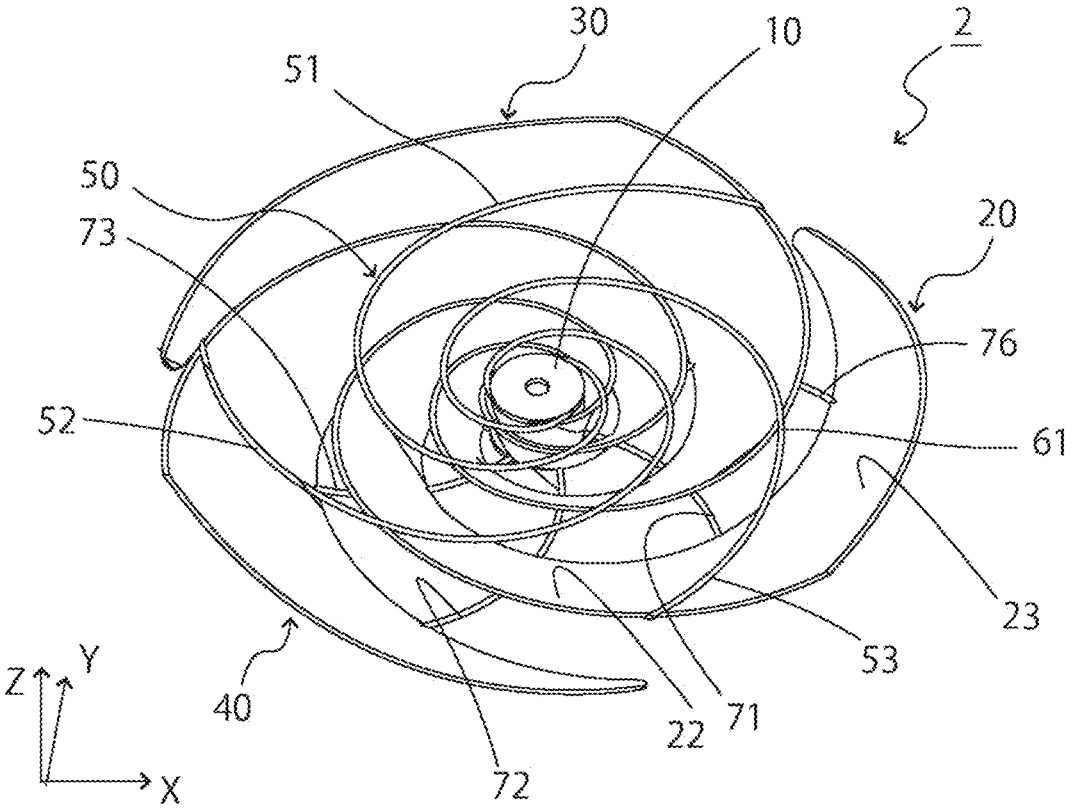
FIG. 4 is a perspective view of a rotor blade according to a second embodiment of the present invention.
Figure 5:
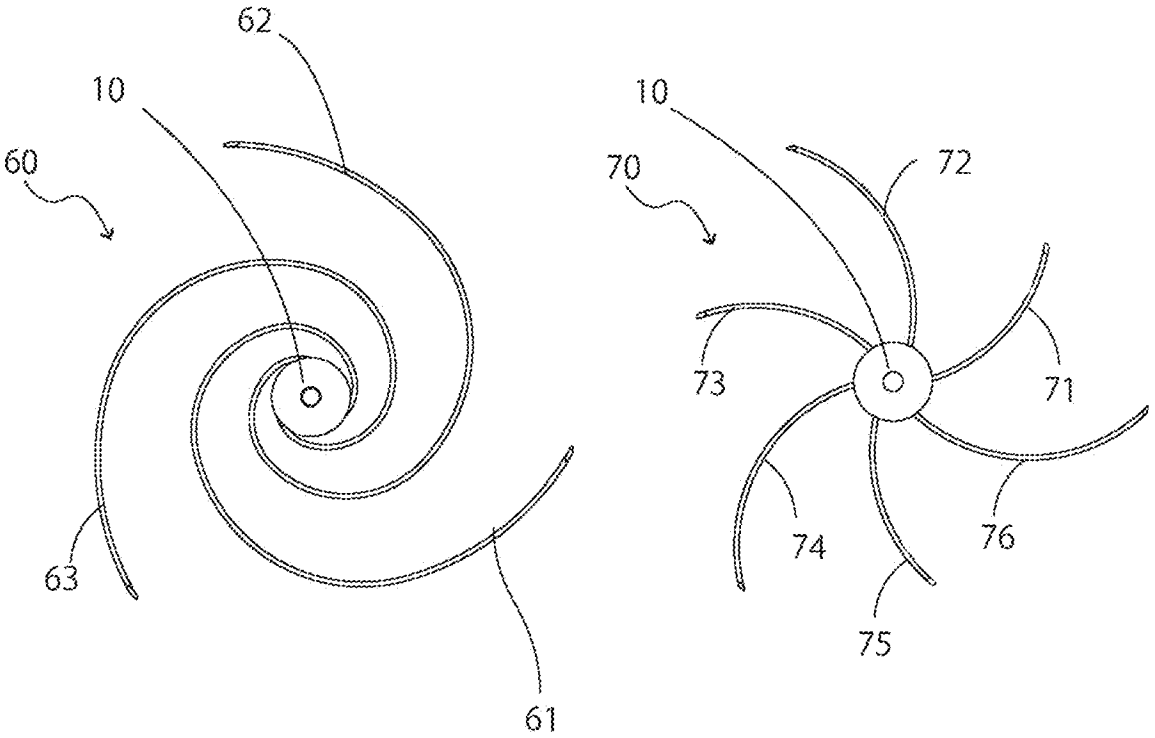
FIG. 5 includes a bottom view of a second reinforcing group (reinforcing portions) of the rotor blade according to the second embodiment on the right side and a bottom view of a second reinforcing group (reinforcing portions) of the rotor blade according to the first embodiment on the left side.

FIG. 4 illustrates a perspective view of a rotor blade according to a second embodiment of the present invention. FIG. 5 illustrates a bottom view of a second reinforcing group (reinforcing portions) 70 of the rotor blade according to the second embodiment on the right side and a bottom view of the second reinforcing group (reinforcing portions) 60 of the rotor blade according to the first embodiment on the left side for comparison. A rotor blade 2 according to the second embodiment of the present invention includes the hub 10, the first blade 20, the second blade 30, and the third blade 40 as a plurality of blades, the first reinforcing group 50, and the second reinforcing group 70. Components identical to those in the drawings illustrating the first embodiment are provided with identical reference numerals, and overlapping descriptions are avoided.

Unlike the rotor blade 1 according to the first embodiment, in the rotor blade 2 according to the second embodiment of the present invention, a first reinforcing portion 71, a second reinforcing portion 72, a third reinforcing portion 73, a fourth reinforcing portion 74, a fifth reinforcing portion 75, and a sixth reinforcing portion 76 constituting the second reinforcing group 70 have a smaller curvature than the first reinforcing portion 51, the second reinforcing portion 52, and the third reinforcing portion 53 constituting the first reinforcing group 50. This reduces the number of times the first reinforcing portion 71, the second reinforcing portion 72, the third reinforcing portion 73, the fourth reinforcing portion 74, the fifth reinforcing portion 75, and the sixth reinforcing portion 76 constituting the second reinforcing group 70 are connected to the first blade 20, the second blade 30, and the third blade 40. In addition, the number of reinforcing portions constituting the second reinforcing group 70 also increases. The illustrated number of six is an example of the number of reinforcing portions of the second reinforcing group 70, and the number of reinforcing portions according to the curvature may be used. Others are similar to the first embodiment.

Third Embodiment

Figure 6:
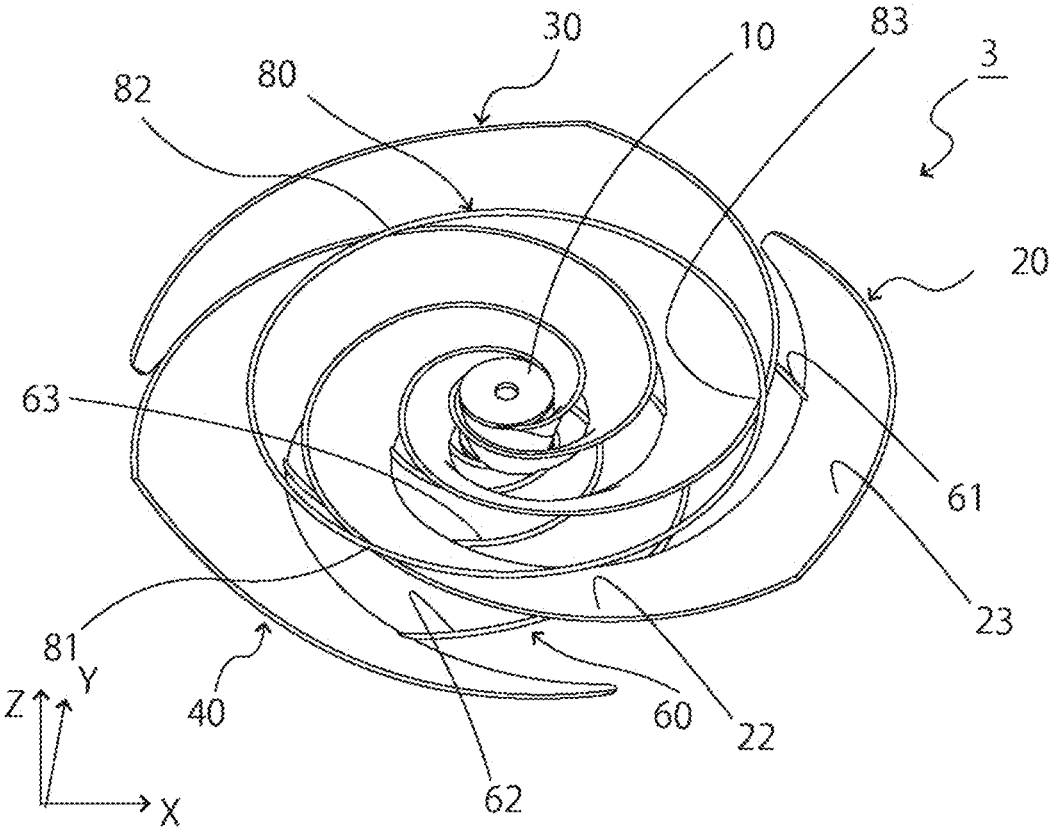
FIG. 6 is a perspective view of a rotor blade according to a third embodiment of the present invention.

FIG. 6 is a perspective view of a rotor blade according to a third embodiment of the present invention. A rotor blade 3 according to the third embodiment of the present invention includes the hub 10, the first blade 20, the second blade 30, and the third blade 40 as a plurality of blades, the plurality of reinforcing portions 60, and a ring portion 80. Components identical to those in the drawings illustrating the first embodiment are provided with identical reference numerals, and overlapping descriptions are avoided.

Unlike the first embodiment of the present invention, in the rotor blade 3 according to the third embodiment of the present invention, the first reinforcing group 50 is not disposed on the one direction side of the first blade 20, the second blade 30, and the third blade 40 as a plurality of blades, and the ring portion 80 is disposed in a shape symmetrical to the hub 10. As illustrated in FIG. 6, the ring portion 80 has a circular ring shape with a predetermined radius. The ring portion 80 preferably has a radius of ½ to ⅓ or more of a radius of the first blade 20, the second blade 30, and the third blade 40 as a plurality of blades (the radius of the arcs of the upper ends of the distal end portions). The radius of the ring portion 80 is equal to or less than the radius of the first blade 20, the second blade 30, and the third blade 40 as a plurality of blades (the radius of the arcs of the upper ends of the distal end portions). This is because the deformation of the first blade 20, the second blade 30, and the third blade 40 as a plurality of blades can be suppressed. The ring portion 80 is connected to the first blade 20, the second blade 30, and the third blade 40 at connection positions 81, 82, 83, respectively.

Fourth Embodiment

Figure 7:
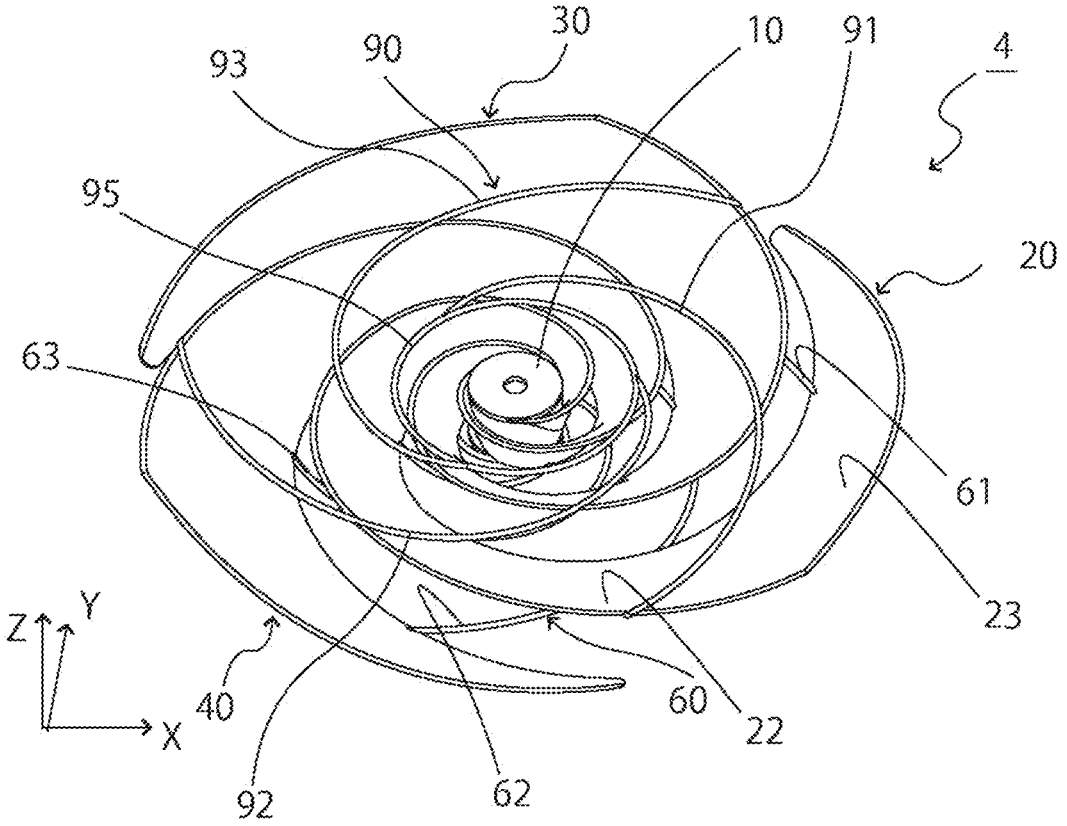
FIG. 7 is a perspective view of a rotor blade according to a fourth embodiment of the present invention.

FIG. 7 is a perspective view of a rotor blade according to a fourth embodiment of the present invention. A rotor blade 4 according to the fourth embodiment of the present invention includes the hub 10, the first blade 20, the second blade 30, and the third blade 40 as a plurality of blades, a first reinforcing group 90, the second reinforcing group 60, and a ring portion 95. Components identical to those in the drawings illustrating the first embodiment are provided with identical reference numerals, and overlapping descriptions are avoided.

In the rotor blade 4 according to the fourth embodiment of the present invention, the ring portion 95 is disposed in a shape symmetrical to the hub 10 on the one-direction side of the first blade 20, the second blade 30, and the third blade 40 as a plurality of blades. The ring portion 95 has a circular ring shape with a predetermined radius. However, unlike the third embodiment, the ring portion 95 preferably has a radius of ½ or less of the radius of the first blade 20, the second blade 30, and the third blade 40 as a plurality of blades (the radius of the arcs of the upper ends of the distal end portions), more preferably a radius of ⅓ or less or ¼ or less.

Parts on one end (base end) sides of a first reinforcing portion 91, a second reinforcing portion 92, and a third reinforcing portion 93 constituting the first reinforcing group 90, as in the first embodiment of the present invention, are connected to the ring portion 95. Parts on the other end (distal end) sides of the first reinforcing portion 91, the second reinforcing portion 92, and the third reinforcing portion 93 are connected to the first blade 20, the second blade 30, and the third blade 40 at respective connection positions farthest from the hub 10. Thus, the ring portion 95 and the first reinforcing group 90 can suppress the deformation of the first blade 20, the second blade 30, and the third blade 40 due to the fluid from the +Z-direction side or the fluid extruded toward the +Z-direction side.

Fifth Embodiment

Figure 8:
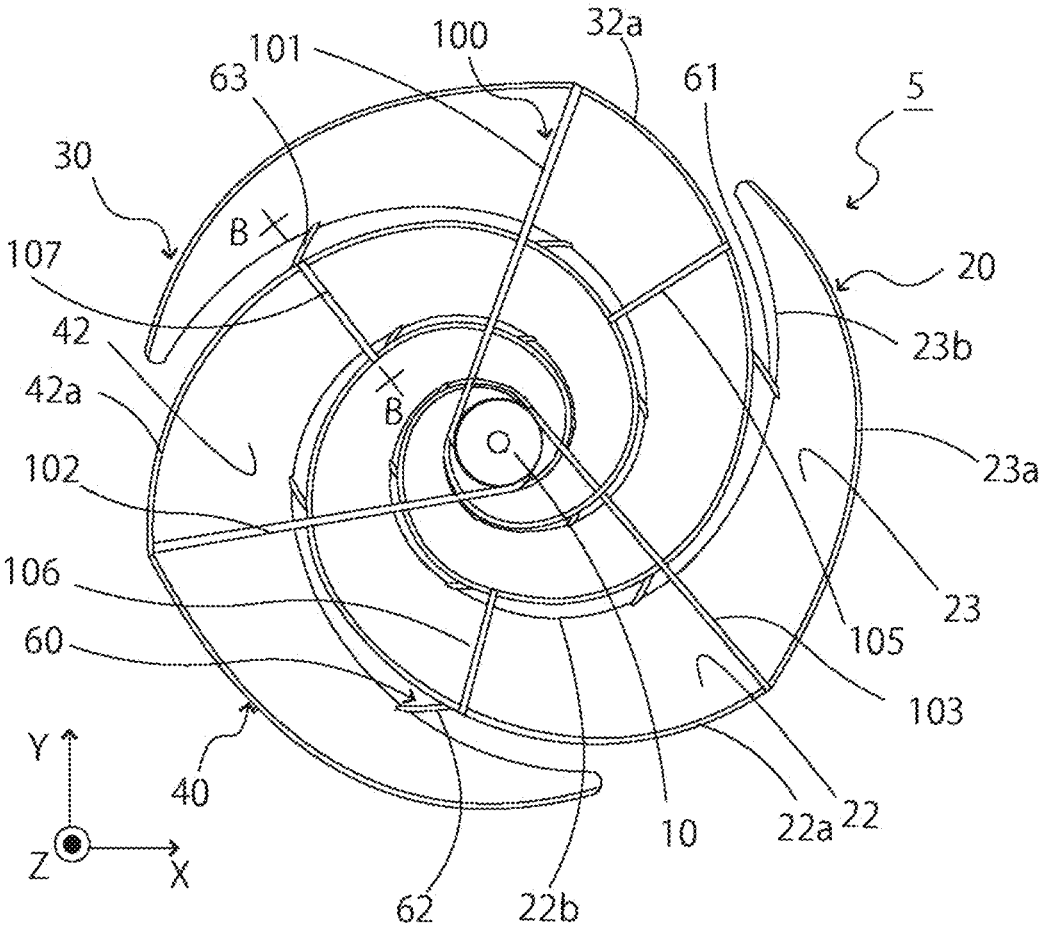
FIG. 8 is a plan view of a rotor blade according to a fifth embodiment of the present invention.

FIG. 8 illustrates a plan view of a rotor blade according to a fifth embodiment of the present invention. A rotor blade 5 according to the fifth embodiment of the present invention includes the hub 10, the first blade 20, the second blade 30, and the third blade 40 as a plurality of blades, a first reinforcing group 100, and the second reinforcing group 60. Components identical to those in the drawings illustrating the first embodiment are provided with identical reference numerals, and overlapping descriptions are avoided.

Figure 9A:
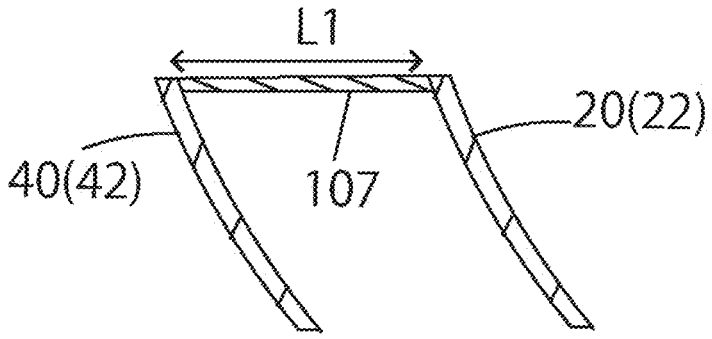
FIG. 9A is a partial cross-sectional view along the line B-B in FIG. 8.

Unlike the rotor blade 1 according to the first embodiment, in the rotor blade 5 according to the fifth embodiment of the present invention, the first reinforcing group 100 includes a first reinforcing portion 101, a second reinforcing portion 102, and a third reinforcing portion 103, which have straight line shapes, and preferably includes a fourth reinforcing portion 105, a fifth reinforcing portion 106, and a sixth reinforcing portion 107, which have straight line shapes. Each of the first reinforcing portion 101, the second reinforcing portion 102, and the third reinforcing portion 103 is disposed to be connected to the hub 10 and the respective upper ends of the first blade 20, the second blade 30, and the third blade 40. At that time, the first reinforcing portion 101, the second reinforcing portion 102, and the third reinforcing portion 103 are connected to the respective upper ends of the first blade 20, the second blade 30, and the third blade 40 most distant from the hub 10. Each of the first reinforcing portion 101, the second reinforcing portion 102, and the third reinforcing portion 103 extends across all the blades adjacent to one another and extends to be equally spaced around hub 10. As a partial cross-sectional view along the line B-B in FIG. 8 is illustrated in FIG. 9A, the sixth reinforcing portion 107 lies between the blade main body portion 22 of the first blade 20 and a blade main body portion 42 of the third blade 40 adjacent to one another in a radial direction (distance L1) and extends in the radial direction between their upper ends. The fourth reinforcing portion 105 also lies between a blade main body portion 32 of the second blade 30 and the blade main body portion 42 of the third blade 40 adjacent to one another and extends in the radial direction between their upper ends. The fifth reinforcing portion 106 also lies between the first blade 20 and the second blade 30 adjacent to one another in the radial direction and extends in the radial direction between the upper ends of their blade main body portions. Since the fourth reinforcing portion 105, the fifth reinforcing portion 106, and the sixth reinforcing portion 107 are each disposed at a part far from the hub 10 between two blades with at least parts of both ends connected, they suppress the deformation of the corresponding two blades efficiently. As in the plan view illustrated in FIG. 8, the fourth reinforcing portion 105, the fifth reinforcing portion 106, and the sixth reinforcing portion 107 are each disposed between any two of the first reinforcing portion 101, the second reinforcing portion 102 and the third reinforcing portion 103 when viewed in a circumferential direction of the hub 10. The fourth reinforcing portion 105, the fifth reinforcing portion 106, and the sixth reinforcing portion 107, which have straight line shapes, may be disposed without providing the first reinforcing portion 101, the second reinforcing portion 102, and the third reinforcing portion 103, which have straight line shapes.

Figure 9B:
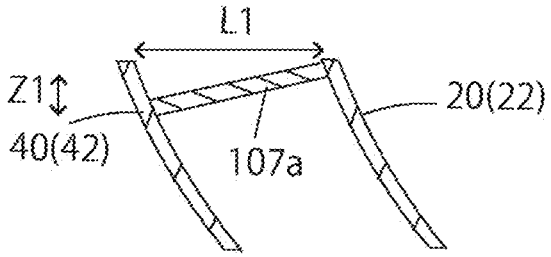
FIG. 9B is a cross-sectional view according to a modification of the part along the line B-B in FIG. 8.

The fifth embodiment of the rotor 5 can also achieve the same operational effects as the first embodiment. As a cross-sectional view according to a modification of the part along the line B-B in FIG. 8 is illustrated in FIG. 9B, a sixth reinforcing portion 107*a* lies between the blade main body portion 22 of the first blade 20 and the blade main body portion 42 of the third blade 40 adjacent to one another in the radial direction and also extends in the Z-axis direction. Here, in the sixth reinforcing portion 107*a*, the sixth reinforcing portion 107*a* between the blades adjacent to one another in the radial direction (distance L1) has an inclined dimension such that an axial distance Z1 is equal to or less than ½ of the radial distance L1. This is to respond to a case where, depending on the fourth reinforcing portion 105, the fifth reinforcing portion 106, or the sixth reinforcing portion 107, they cannot necessarily be disposed on the upper end of the corresponding blade due to an attaching state and processing convenience, as illustrated in FIG. 9B. Also, for the first reinforcing portion 101, the second reinforcing portion 102, and the third reinforcing portion 103, which have straight line shapes, not only are they on a plane intersecting with the rotation axis, but at least any of the first reinforcing portion 101, the second reinforcing portion 102, and the third reinforcing portion 103 between the blades adjacent to one another in the radial direction is also inclined such that the axial distance of is equal to or less than ½ of the radial distance.

Here, in the first to fifth embodiments, the dimensions in the Z-direction of the reinforcing portions can be ignored compared to the dimensions in the Z-axis direction of the blades.

Sixth Embodiment

Figure 12:
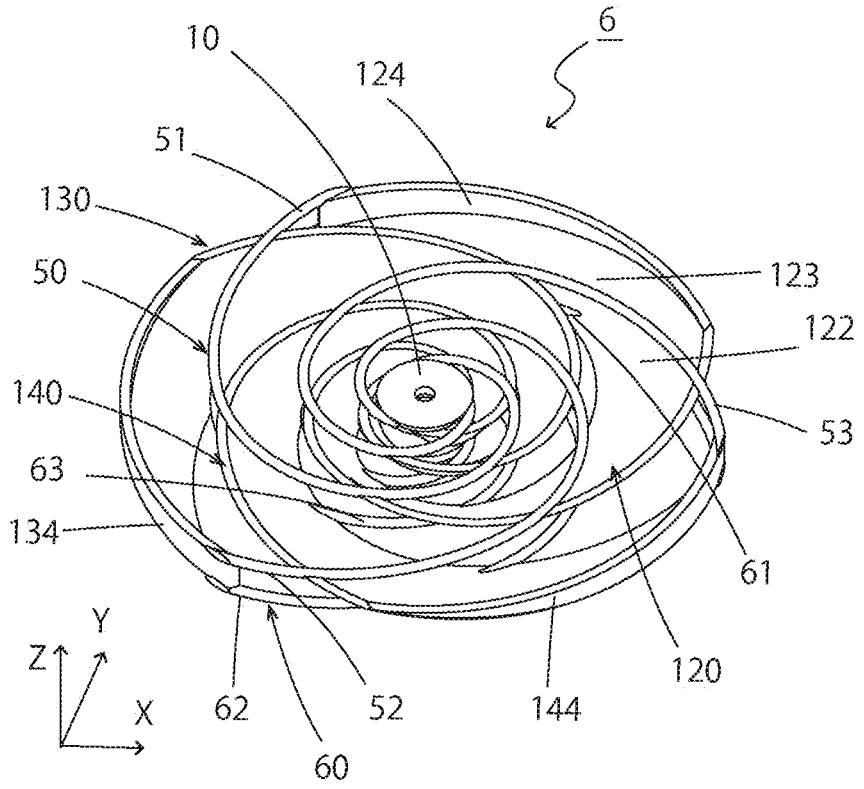
FIG. 12 is a perspective view of a rotor blade according to a sixth embodiment of the present invention.

FIG. 12 illustrates a perspective view of a rotor blade 6 according to a sixth embodiment of the present invention.

The rotor blade 6 according to the sixth embodiment of the present invention is configured to include the hub 10, a first blade 120, a second blade 130, and a third blade 140 as a plurality of blades, the reinforcing portions 50, and the reinforcing portions 60. Each of the first blade 120, the second blade 130, and the third blade 140 includes an end face on a side in one direction (+Z-direction) of the rotation axis of the hub 10 and an end face on a side in the opposite direction (−Z-direction). Each end face is inclined and curved such that the one on the one-direction (+Z-direction) side of the rotation axis is farther away from the rotation axis than the one on the opposite-direction (−Z-direction) side. The hub 10 is similar to the one described in the first embodiment. It is similar to the first embodiment in that the reinforcing portions 50 are disposed on the ends, in one direction of the rotation axis, of the plurality of blades, and the reinforcing portions 60 are disposed on the ends, in the opposite direction of the rotation axis, of the plurality of blades.

While the plurality of blades are constituted of three blades of the first blade 120, the second blade 130, and the third blade 140 as illustrated in FIG. 12, the number of blades may be two, four, or others.

Figure 13A:
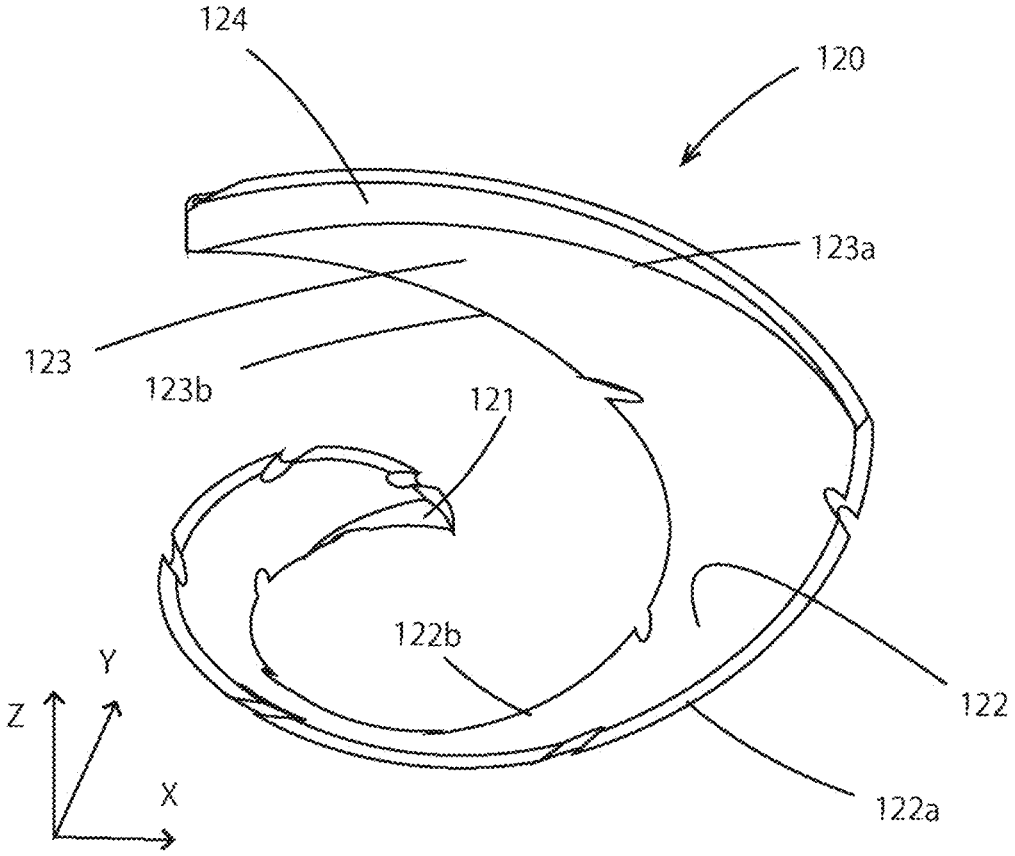
FIG. 13A is a perspective view of a first blade as one blade that constitutes the rotor blade in FIG. 12.
Figure 13B:
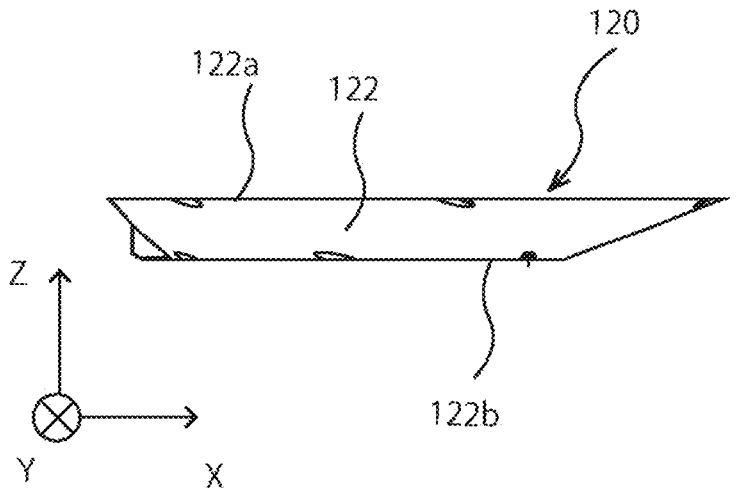
FIG. 13B is a front view of the first blade as one blade that constitutes the rotor blade in FIG. 12.
Figure 13C:
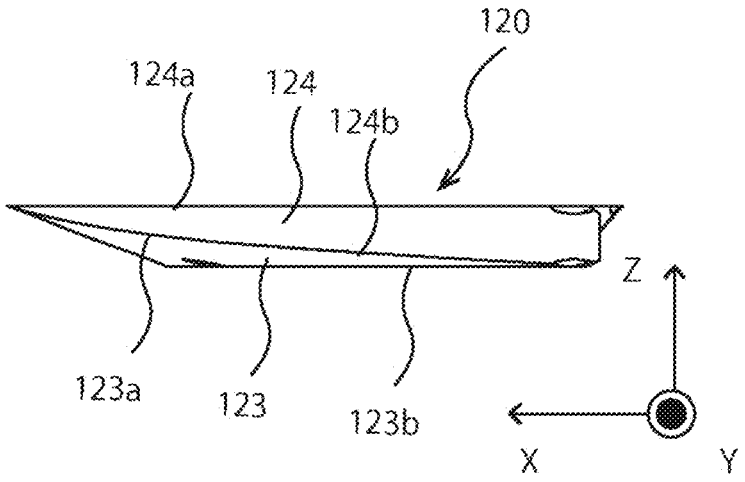
FIG. 13C is a back view of the first blade as one blade that constitutes the rotor blade in FIG. 12.
Figure 13D:
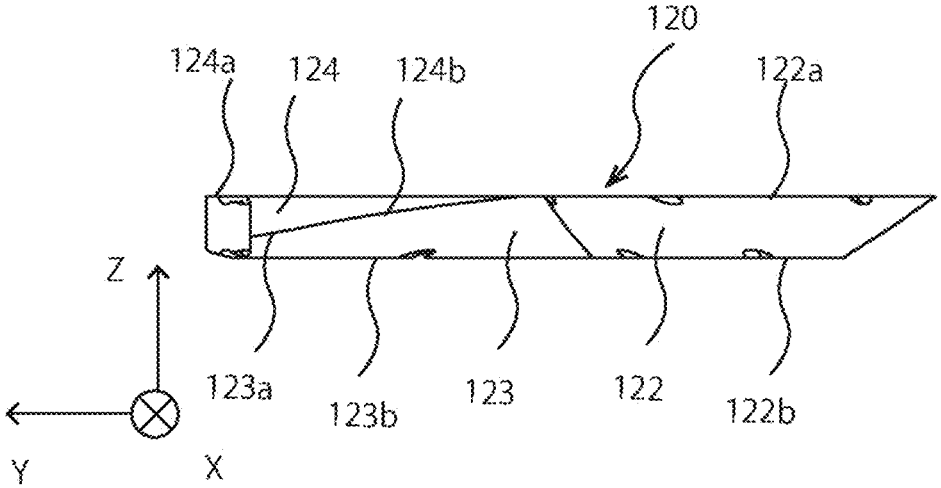
FIG. 13D is a left side view of the first blade as one blade that constitutes the rotor blade in FIG. 12.
Figure 13E:
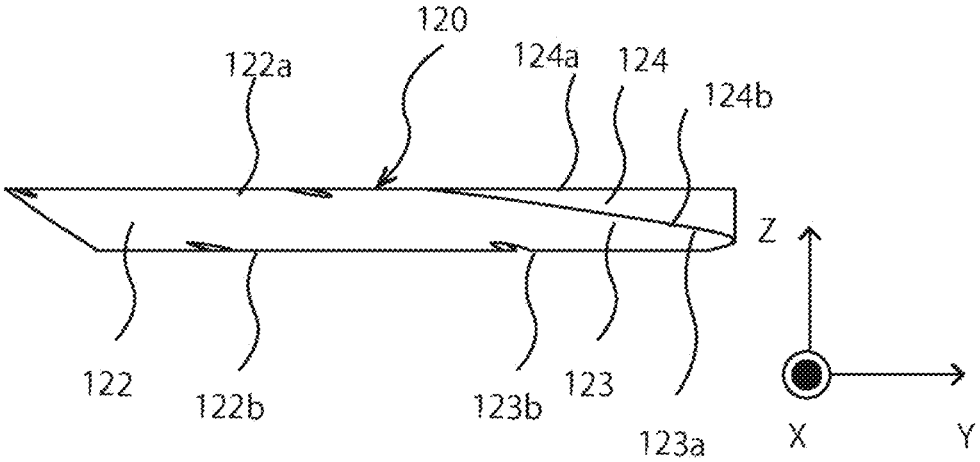
FIG. 13E is a right side view of the first blade as one blade that constitutes the rotor blade in FIG. 12.

FIGS. 13A, 13B, 13C, 13D, and 13E illustrate in sequence a perspective view, a front view, a back view, a left side view, and a right side view of the first blade 120 as one blade that constitutes the rotor blade 6 in FIG. 12, respectively. As illustrated in FIG. 12, the first blade 120 has one end connected to the hub 10 and is disposed to be curved around the hub 10. The first blade 120 is configured as a unit by including a connecting portion 121, a blade main body portion 122, and an extended portion 123, and a pedestal portion 124 is disposed on the extended portion 123. In FIG. 13A, the connecting portion 121 of the first blade 120 corresponds to the curvature of the hub 10, and the connecting portion 121 is connected to the hub 10.

Figure 14A:
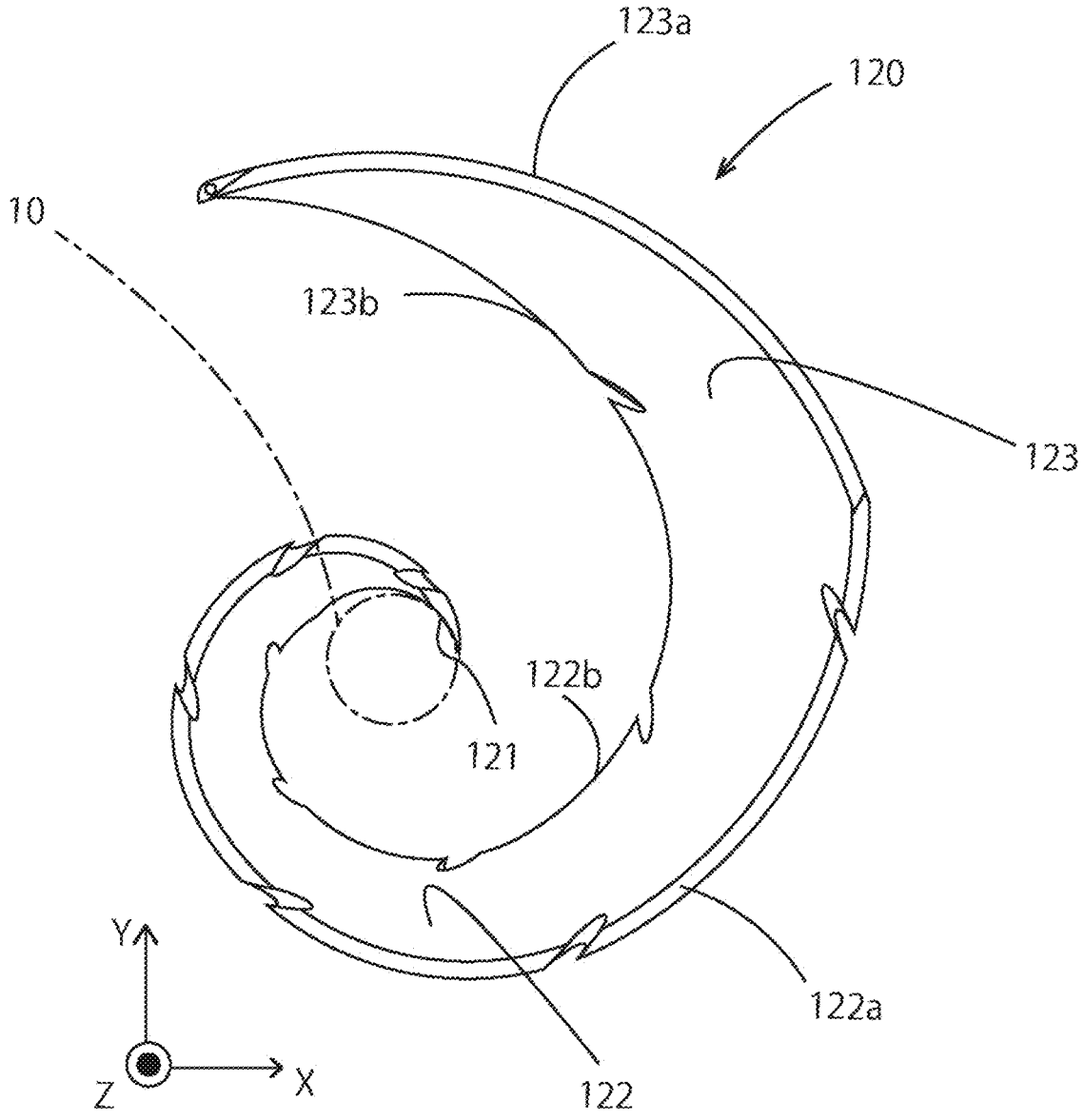
FIG. 14A is a plan view of a connecting portion, a blade main body portion, and an extended portion illustrated in FIG. 13A.
Figure 14B:
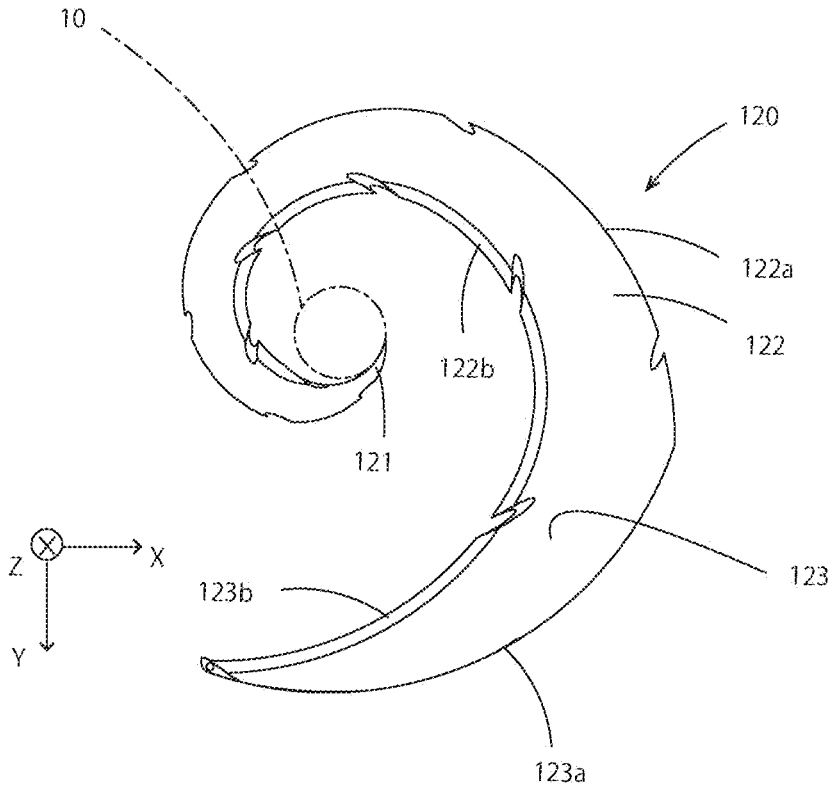
FIG. 14B is a bottom view of the connecting portion, the blade main body portion, and the extended portion illustrated in FIG. 13A.
Figure 15A:
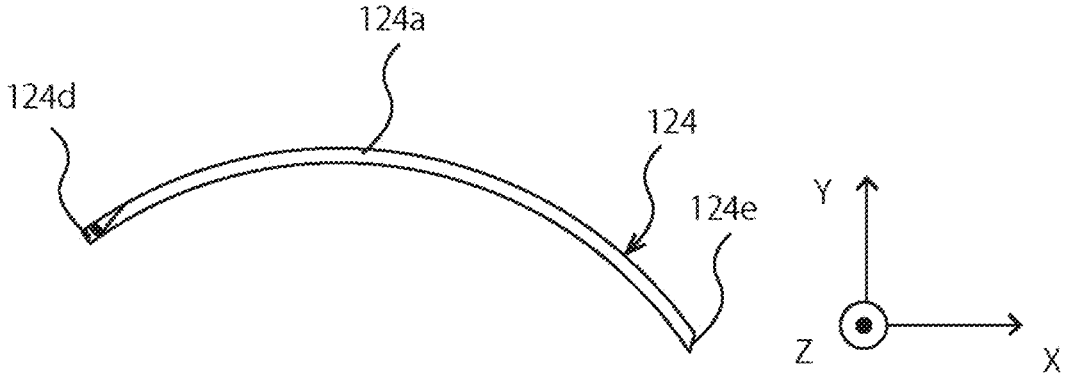
FIG. 15A is a plan view of a pedestal portion illustrated in FIG. 13A.
Figure 15B:
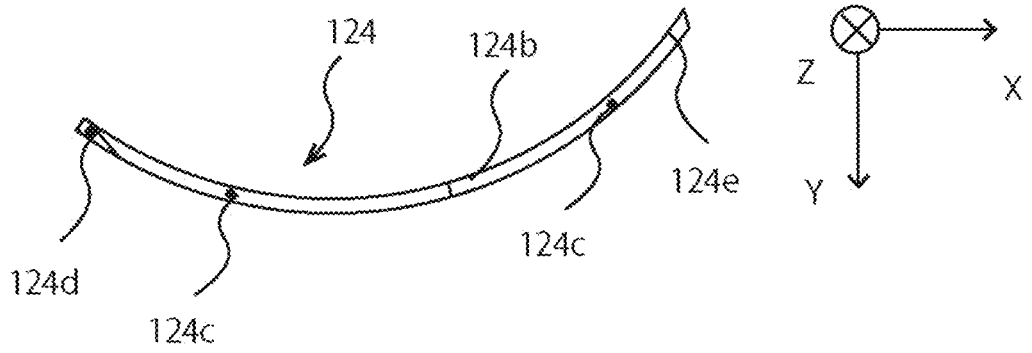
FIG. 15B is a bottom view of the pedestal portion illustrated in FIG. 13A.
Figure 15C:
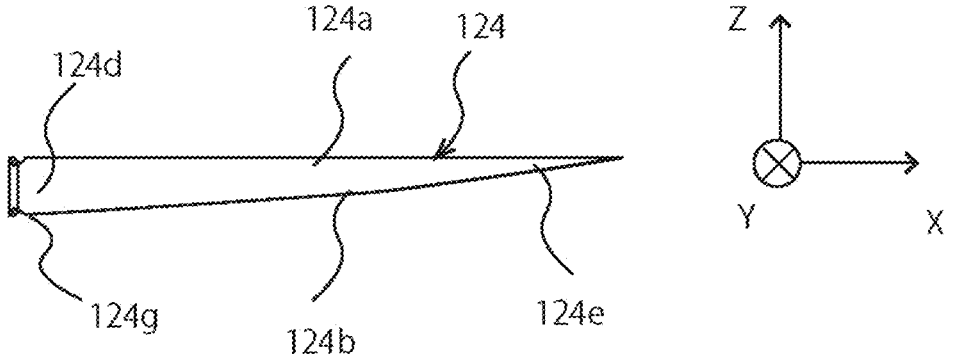
FIG. 15C is a front view of the pedestal portion illustrated in FIG. 13A.
Figure 15D:
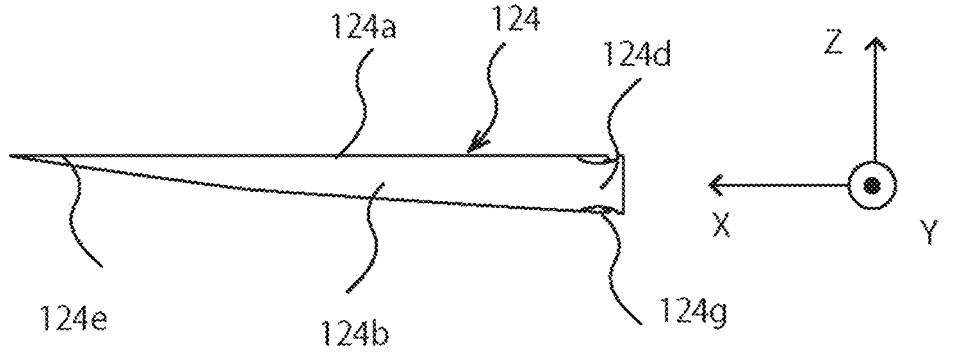
FIG. 15D is a back view of the pedestal portion illustrated in FIG. 13A.
Figure 15E:
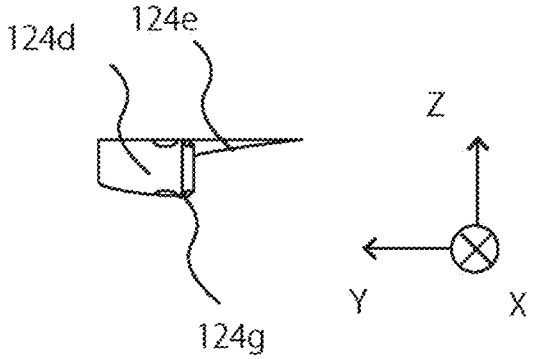
FIG. 15E is a left side view of the pedestal portion illustrated in FIG. 13A.
Figure 15F:
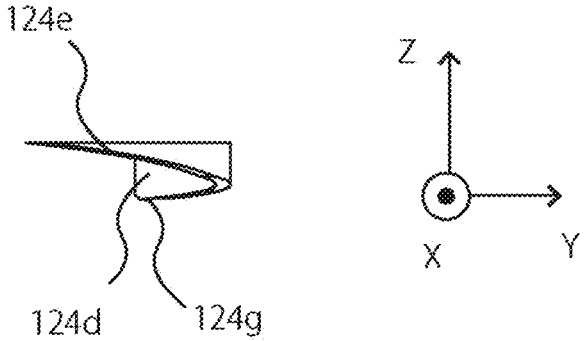
FIG. 15F is a right side view of the pedestal portion illustrated in FIG. 13A.

FIG. 14A illustrates a plan view of the connecting portion 121, the blade main body portion 122, and the extended portion 123, and FIG. 14B illustrates a bottom view of the connecting portion 121, the blade main body portion 122, and the extended portion 123. The blade main body portion 122 has an end (upper end) 122*a* on the one-direction side and an end (lower end) 122*b* on the opposite-direction side. The end (upper end) 122*a* or the end (lower end) 122*b* is formed into any of a logarithmic spiral pattern, a Fibonacci spiral pattern, a Fermat's spiral pattern, a conical spiral pattern, or a hyperbolic spiral pattern, with the hub 10 at the center when viewed from the one-direction side (when the −Z-direction is viewed from the +Z-direction). In the blade main body portion 122, a width parallel to the rotation axis of the hub 10 may be uniform around the hub 10. Here, the terms upper and lower correspond to the illustrated orientation in FIGS. 13A to 13E. The "upper end 122*a*" and the "lower end 122*b*" can also be referred to as "front end" and "rear end," or "rear end" and "front end" from windward to leeward.

The extended portion 123 is disposed on an opposite side of the connecting portion 121 of the blade main body portion 122 around the rotation axis of the hub 10. In the extended portion 123, a width parallel to the rotation axis of the hub 10 is different around the rotation axis of the hub 10. That is, in the extended portion 123, depending on the angle formed with the rotation axis of the hub 10, an end on the one-direction side of the extended portion 123 is approaching an end on the opposite direction side, or conversely, the end on the opposite direction side of the extended portion 123 is approaching the end on the one-direction side. Specifically, in the extended portion 123, an end (upper end, front end) 123*a* on the one-direction side is different in the Z-axis direction from the end (upper end, front end) 122*a* on the one-direction side of the blade main body portion 122, and/or an end (lower end, rear end) 123*b* on the opposite-direction side is different in the Z-axis direction from the end (lower end, rear end) 122*b* on the opposite-direction side of the blade main body portion 122. The illustrated form illustrates the former. The end (lower end, rear end) 122*b* on the opposite-direction side of the blade main body portion 122 and the end (lower end, rear end) 123*b* on the opposite direction side of the extended portion 123 are not different in the Z-axis direction and exist on a plane parallel to the same XY plane. The end (upper end, front end) 123*a* on the one-direction side of the extended portion 123 is approaching a distal end of the end (lower end, rear end) 123*b* on the opposite-direction side of the extended portion 123 when viewed from the +Z-direction (in a counterclockwise direction in a plan view). A length in the Z-axis direction of the extended portion 123 is gradually shortened around the hub 10.

FIGS. 15A, 15B, 15C, 15D, 15E, and 15F are a plan view, a bottom view, a front view, a back view, a left side view, and a right side view of the pedestal portion, respectively. The pedestal portion 124 is disposed on any of a +Z-side, which is the one-direction side of the extended portion 123, or a-Z-side, which is the opposite-direction side. In the illustrated form, the pedestal portion 124 is disposed on the end (upper end) 123*a* on the one direction side of the extended portion 123. An end (lower end, rear end) 124*b* on the opposite direction side of the pedestal portion 124 has the same shape as the end (upper end, front end) 123*a* on the one-direction side of the extended portion 123. An end (upper end, front end) 124*a* on the one-direction side of the pedestal portion 124 is formed such that a height in the Z-direction of the end (upper end, front end) 124*a* from the end (lower end, rear end) 123*b* on the opposite-direction side of the extended portion 123 is equal to that of the blade main body portion 122. The first reinforcing portion 51 is connected to the end (upper end, front end) 124*a* on the one-direction side of a distal end portion 124*d* in the pedestal portion 124, and a base end portion 124*e* of the pedestal portion 124 is smoothly connected to the end (upper end, front end) 122*a* on the one-direction side of the blade main body portion 122. A portion 124*g* on the distal end side of the end (lower end, rear end) on the opposite-direction side in the pedestal portion 124 is smoothly connected to the end (lower end, rear end) 123*b* on the opposite-direction side of the extended portion 123.

Figure 16:
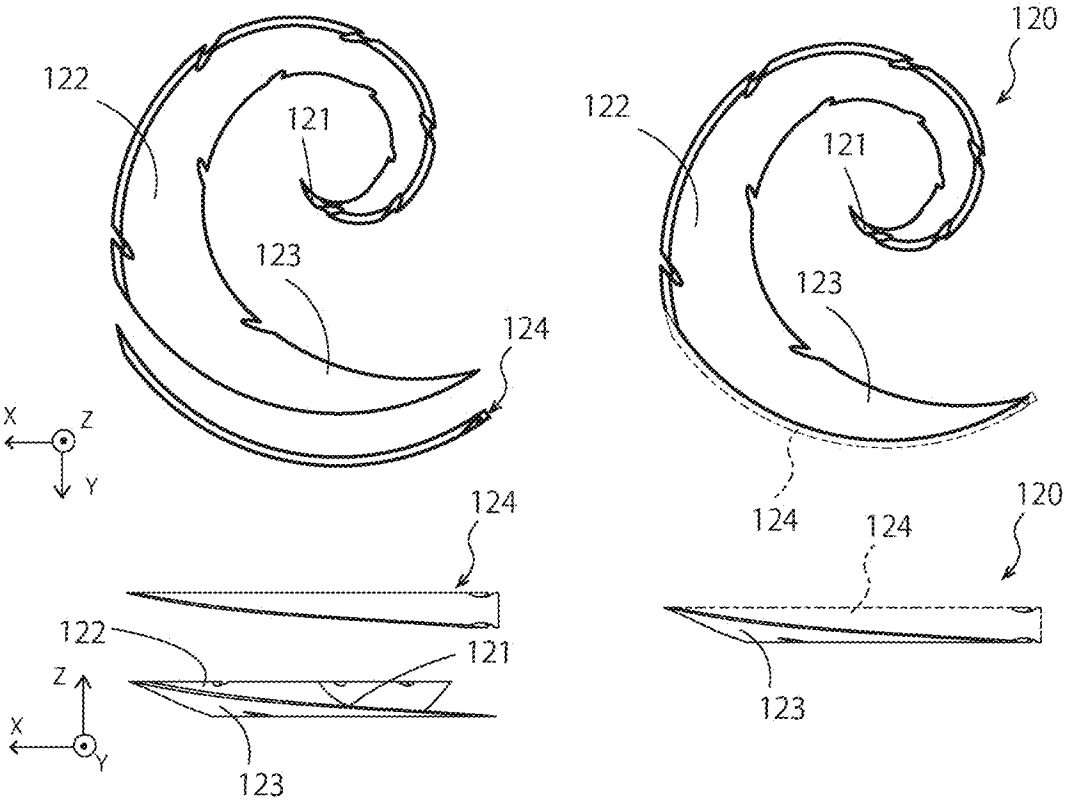
FIG. 16 is a schematic diagram illustrating a relationship of the blade main body portion and the extended portion with respect to the pedestal portion in the first blade illustrated in FIG. 12 and illustrates the relationship in a plan view of the blade main body portion and the extended portion with respect to the pedestal portion, the relationship in a back view of the blade main body portion and the extended portion with respect to the pedestal portion, a plan view of the first blade, and a back view of the first blade, in the upper-left stage, the lower-left stage, the upper-right stage, and the lower-right stage, respectively.
Figure 17:
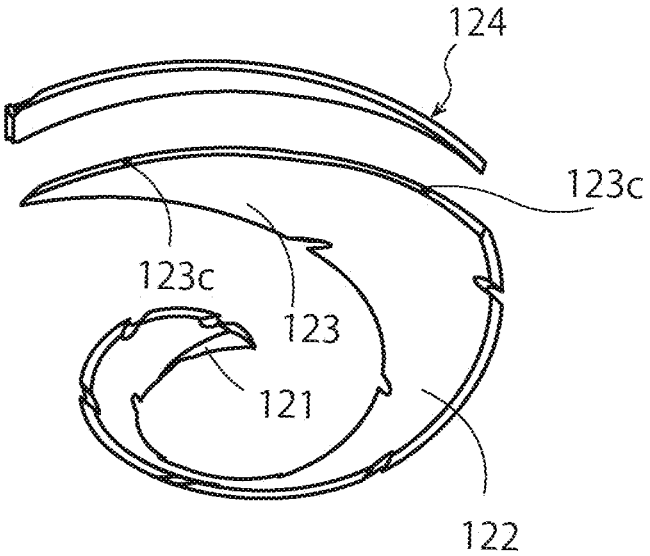
FIG. 17 is a diagram schematically illustrating a method for assembling the first blade illustrated in FIG. 13A.
Figure 17:
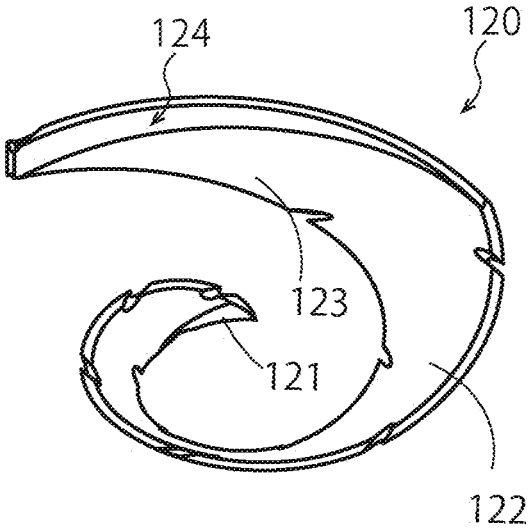

FIG. 16 is a schematic diagram illustrating a relationship of the blade main body portion 122 and the extended portion 123 with respect to the pedestal portion 124 in the first blade illustrated in FIG. 12 and illustrates the relationship in a plan view of the blade main body portion 122 and the extended portion 123 with respect to the pedestal portion 124, the relationship in a back view of the blade main body portion 122 and the extended portion 123 with respect to the pedestal portion 124, a plan view of the first blade 120, and a back view of the first blade 120, in the upper-left stage, the lower-left stage, the upper-right stage, and the lower-right stage, respectively. The upper-left stage and the lower-left stage illustrate the positional relationships before the pedestal portion 124 is attached to the blade main body portion 122 and the extended portion 123. FIG. 17 is a diagram schematically illustrating a method for assembling the first blade 120 illustrated in FIG. 13A.

Here, the pedestal portion 124 is configured as a component itself and is attached to the extended portion 123 configured as a unit by including the connecting portion 121, the blade main body portion 122, and the extended portion 123, thereby constituting the first blade 120 as a whole. As illustrated in FIG. 17, convex-shaped engaging portions 123*c* are provided on an attachment surface of the extension section 123 to which the pedestal section 124 is attached. Concave-shaped engaging portions 124*c* (see FIG. 15B) are provided on an attachment surface the pedestal portion 124 to which the extended portion 123 is attached. The engaging portions 124*c* are inserted into the engaging portions 123*c*. This is because it is possible to mutually position the extended portion 123 and the pedestal portion 124. The engaging portions 123*c*, 124*c* are examples. The engaging portions 123*c* illustrated in FIG. 17 may have a concave shape, and the engaging portions 124*c* illustrated in FIG. 15B may have a convex shape.

In the rotor blade 6 according to the sixth embodiment of the present invention, in the first blade 120, the end (upper end, front end) 122*a* on the one-direction side and the end (lower end, rear end) 122*b* on the opposite-direction side each lie on the same plane by the blade main body portion 122, the extended portion 123, and the pedestal portion 124. Therefore, as illustrated in FIG. 12, the reinforcing portions 51 can be attached to respective upper and lower (front and rear) distal end portions of the first blade 120. Accordingly, the rigidity of the distal end portions of the first blade 120 can be increased, and deformation, such as twisting, can be suppressed.

Such a form can be applied to rotary blades where higher rigidity is required, such as turbines for hydroelectric power generation and aircraft propellers.

Figure 18A:
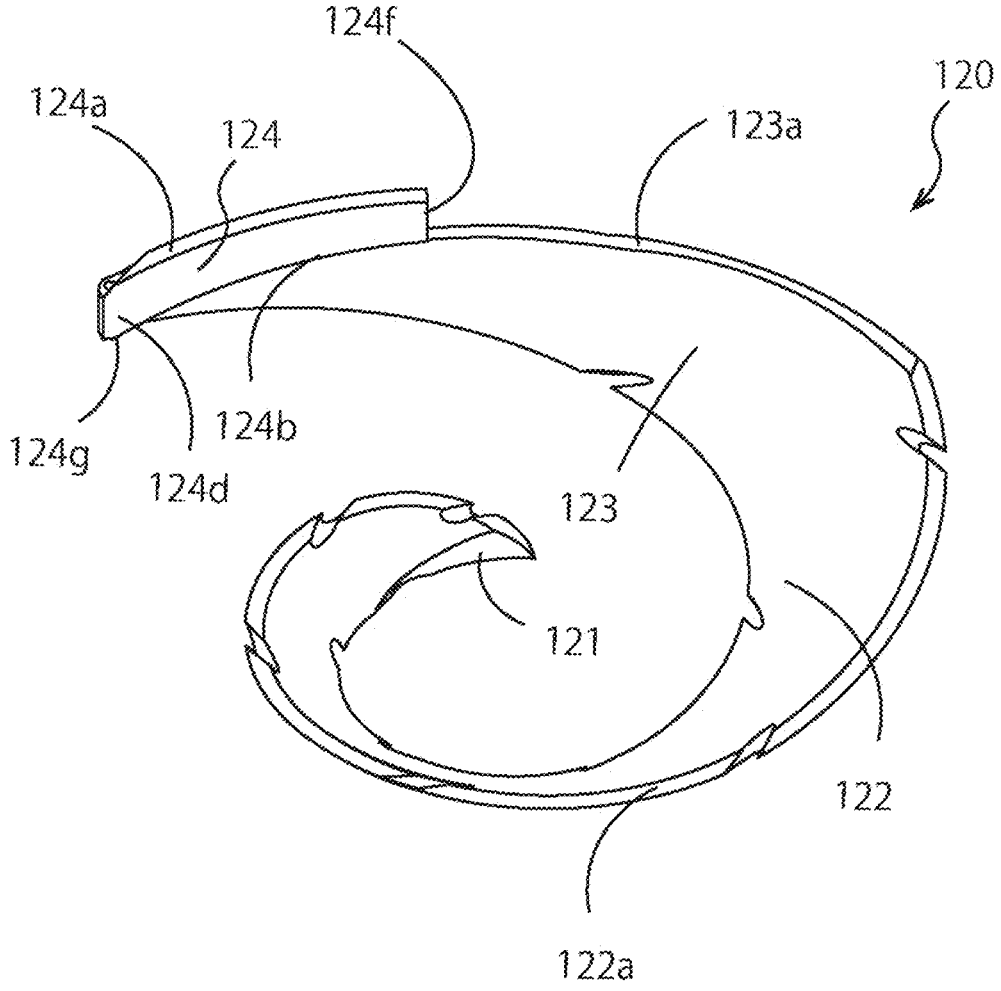
FIG. 18A is a perspective view of a first blade that constitutes a rotor blade according to a seventh embodiment of the present invention.
Figure 19A:
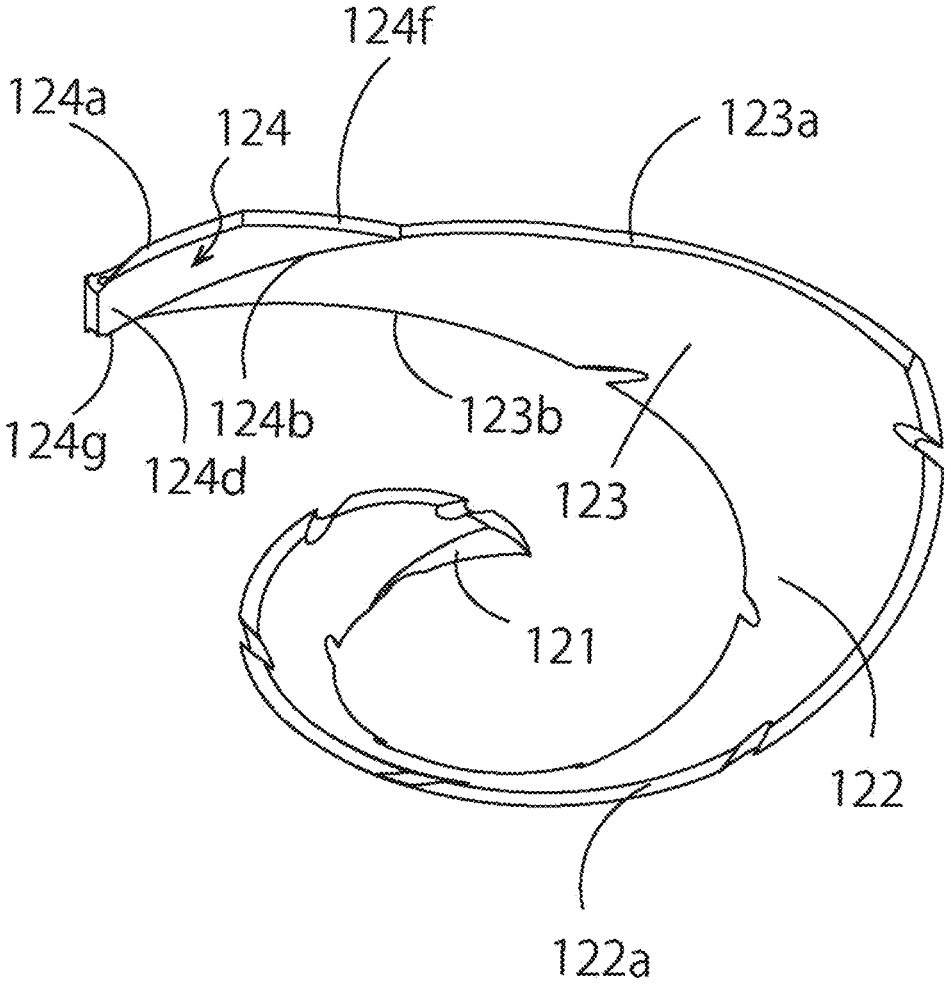
FIG. 19A is a perspective view of a first blade that constitutes a rotor blade according to an eighth embodiment of the present invention.

Although not illustrated, the pedestal portion may project to the distal end side in the circumferential direction with respect to the extended portion. In this case, the −Z-side of the pedestal portion exists on the same plane as the lower end (rear end) of the extended portion (see FIG. 18A and FIG. 19A illustrating seventh and eighth embodiments).

In the pedestal portion 124, a part (an end face of the distal end), which is farthest in the circumferential direction around the hub 10 with respect to the distal end of the extended portion 123, exists, and in such a form, the distal end side of the end (lower end, rear end) on the opposite-direction side of the pedestal portion 124 is disposed along the end (lower end, rear end) 123*b* on the opposite-direction side of the extended portion 123. The distal end side of the end (lower end, rear end) on the opposite-direction side of the pedestal portion 124 does not change in the Z-axis direction, similarly to the end (lower end, rear end) 123*b* on the opposite-direction side of the extended portion 123, and exists on the same plane.

The pedestal portion 124 may be in a form where it is disposed on the end (upper end, front end) in one direction of the extended portion 123 as illustrated, may be in a form where it is disposed on the end (lower end, rear end) in the opposite direction of the extended portion 123, or may be in a form where it is disposed on the end (upper end, front end) in one direction of the extended portion 123 and on the end (lower end, rear end) in the opposite direction of the extended portion 123. The second blade 130 and the third blade 140 are similar to the first blade 120. The second blade 130 is configured as a unit by including a connecting portion, a blade main body portion, and an extended portion, and a pedestal portion 134 is disposed on the extended portion. The third blade 140 is configured as a unit by including a connecting portion, a blade main body portion, and an extended portion, and a pedestal portion 144 is disposed on the extended portion. Since the details are similar to those of the first blade 120, the description is omitted.

Seventh Embodiment

Figure 18B:
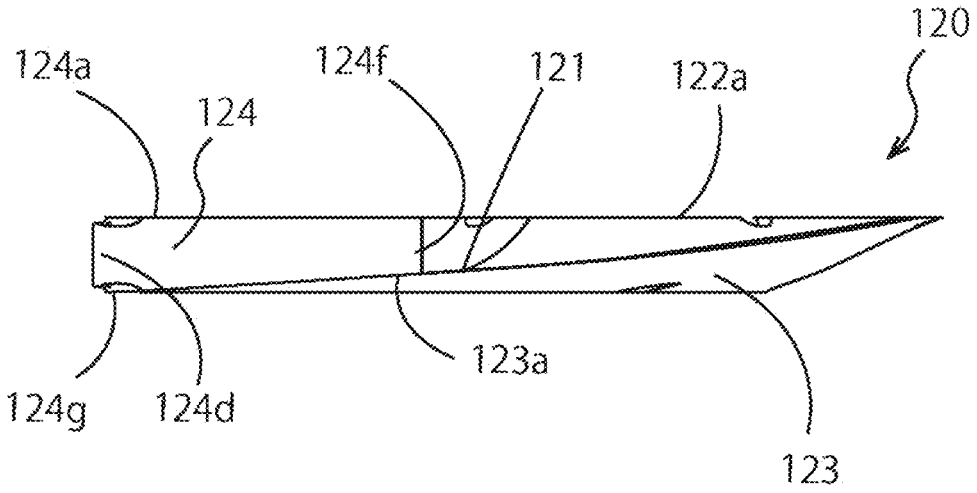
FIG. 18B is a back view of the first blade that constitutes the rotor blade according to the seventh embodiment of the present invention.

FIG. 18A is a perspective view of the first blade 120 that constitutes a rotor blade according to the seventh embodiment of the present invention, and FIG. 18B is a back view of the first blade 120. As illustrated, similarly to the sixth embodiment, in the first blade 120, the connecting portion 121, the blade main body portion 122, and the extended portion 123 are integrally configured, and the pedestal portion 124 is configured to be attached to the extended portion 123 as a component.

Unlike the sixth embodiment, it is different in that the pedestal portion 124 is not attached to the entire end (upper end, front end) on the one-direction side of the extended portion 123, the end (upper end, front end) 124*a* on the one-direction side of the pedestal portion 124 is not continuous with the end (upper end, front end) 122*a* on the one-direction side of the blade main body portion 122, and the end (upper end, front end) 123*a* on the one-direction side of the extended portion 123 is partially exposed. In such a form, as illustrated, the pedestal portion 124 has an end face 124*f* along the rotation axis of the hub 10. It is only necessary for the pedestal portion 124 to have a predetermined angle around the rotation axis of the hub 10 as a circumferential dimension sufficient for the reinforcing portion 51 to be attached.

In the pedestal portion 124, a part (an end face of the distal end) 124*d*, which is farthest in the circumferential direction around the hub 10 with respect to the distal end of the extended portion 123, exists, and in such a form, the portion 124*g* on the distal end side of the end (lower end, rear end) on the opposite-direction side of the pedestal portion 124 is disposed along the end (lower end, rear end) 123*b* on the opposite-direction side of the extended portion 123 and exists on the same plane.

The pedestal portion 124 may be in a form where it is disposed on the end (upper end, front end) in one direction of the extended portion 123 as illustrated, may be in a form where it is disposed on the end (lower end, rear end) in the opposite direction of the extended portion 123, or may be in a form where it is disposed on the end (upper end, front end) in one direction of the extended portion 123 and on the end (lower end, rear end) in the opposite direction of the extended portion 123. The second blade 130 and the third blade 140 are similar to the first blade 120.

Eighth Embodiment

Figure 19B:
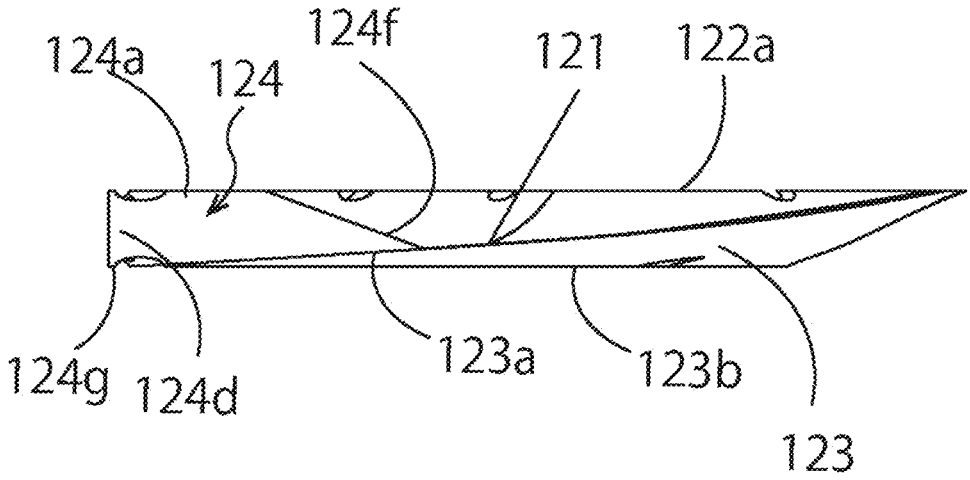
FIG. 19B is a back view of the first blade that constitutes the rotor blade according to the eighth embodiment of the present invention.

FIG. 19A is a perspective view of a first blade that constitutes a rotor blade according to the eighth embodiment of the present invention, and FIG. 19B is a back view of the first blade that constitutes the rotor blade according to the eighth embodiment of the present invention. As illustrated, similarly to the sixth embodiment, in the first blade 120, the connecting portion 121, the blade main body portion 122, and the extended portion 123 are integrally configured, and the pedestal portion 124 is configured to be attached to the extended portion 123 as a component.

It is different in that the pedestal portion 124 is not attached to the entire end (upper end, front end) on the one-direction side of the extended portion 123, the end (upper end, front end) 124*a* on the one-direction side of the pedestal portion 124 is not continuous with the end (upper end, front end) 122*a* on the one-direction side of the blade main body portion 122, and the end (upper end, front end) 123*a* on the one-direction side of the extended portion 123 is exposed. In such a form, as illustrated, the pedestal portion 124 has the end face 124*f* intersecting with the rotation axis of the hub 10. The end face 124*f* and the end (upper end, front end) 123*a* on the one-direction side of the extended portion 123 form an obtuse angle. It is only necessary for the pedestal portion 124 to have a circumferential dimension sufficient for a reinforcing portion to be attached.

In the pedestal portion 124, the part (the end face of the distal end) 124*d*, which is farthest in the circumferential direction around the hub 10 with respect to the distal end of the extended portion 123, exists, and in such a form, the portion 124*g* on the distal end side of the end (lower end, rear end) on the opposite-direction side of the pedestal portion 124 is disposed along the end (lower end, rear end) 123*b* on the opposite direction side of the extended portion 123 and exists on the same plane.

The pedestal portion 124 may be in a form where it is disposed on the end (upper end, front end) in one direction of the extended portion 123 as illustrated, may be in a form where it is disposed on the end (lower end, rear end) in the opposite direction of the extended portion 123, or may be in a form where it is disposed on the end (upper end, front end) in one direction of the extended portion 123 and on the end (lower end, rear end) in the opposite direction of the extended portion 123. The second blade 130 and the third blade 140 are similar to the first blade 120.

Ninth Embodiment

Figure 20A:
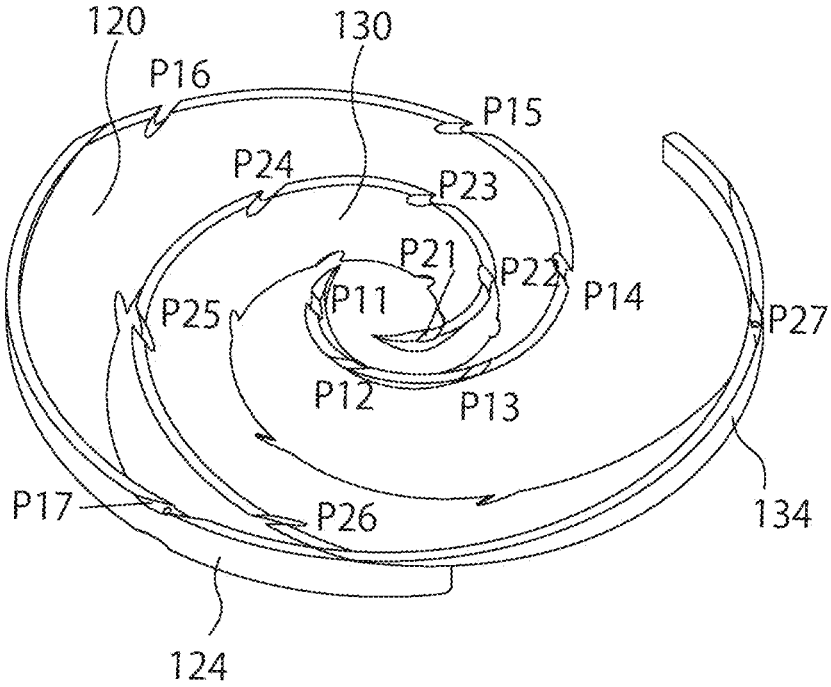
FIG. 20A is a perspective view of a first blade and a second blade that constitute a rotor blade according to a ninth embodiment of the present invention.
Figure 20B:
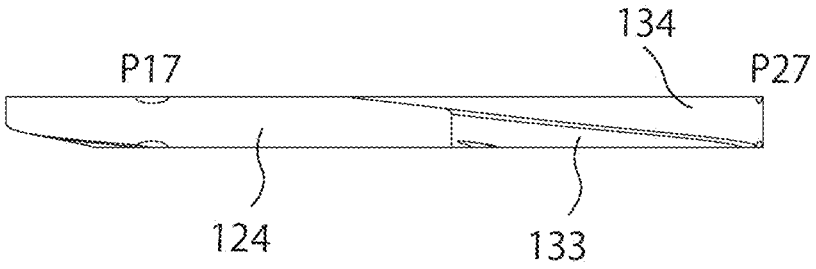
FIG. 20B is a front view of the first blade and the second blade that constitute the rotor blade according to the ninth embodiment of the present invention.
Figure 21A:
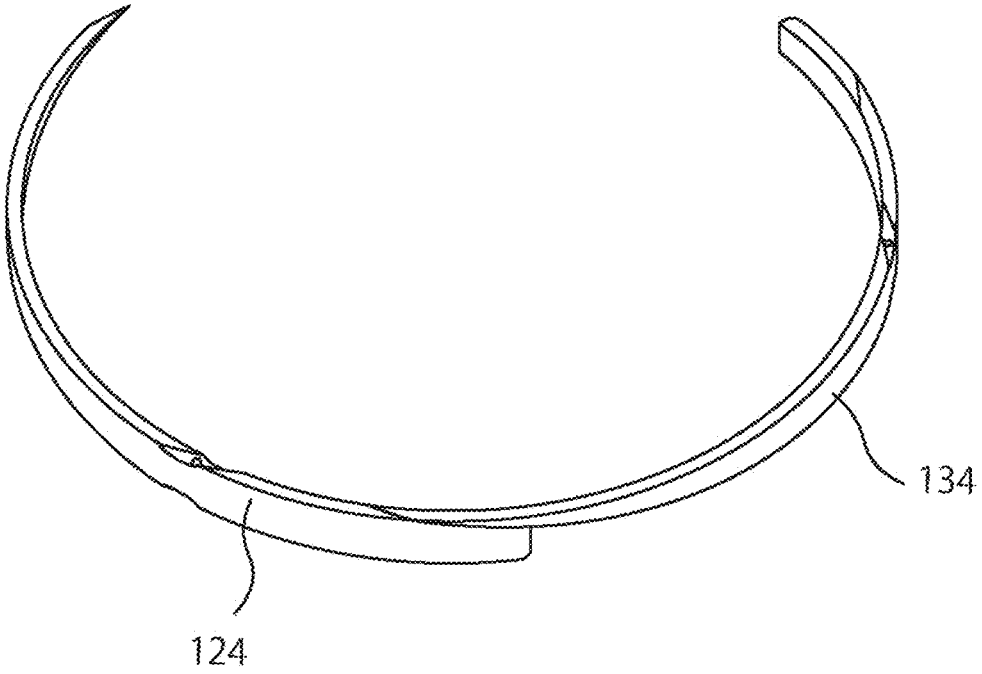
FIG. 21A is a perspective view of pedestal portions illustrated in FIG. 20A.
Figure 21B:
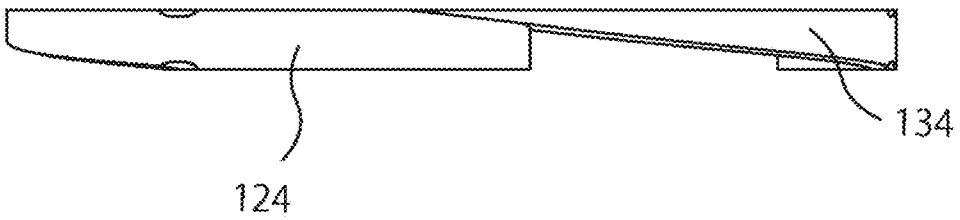
FIG. 21B is a front view of the pedestal portions illustrated in FIG. 20A.
Figure 21C:
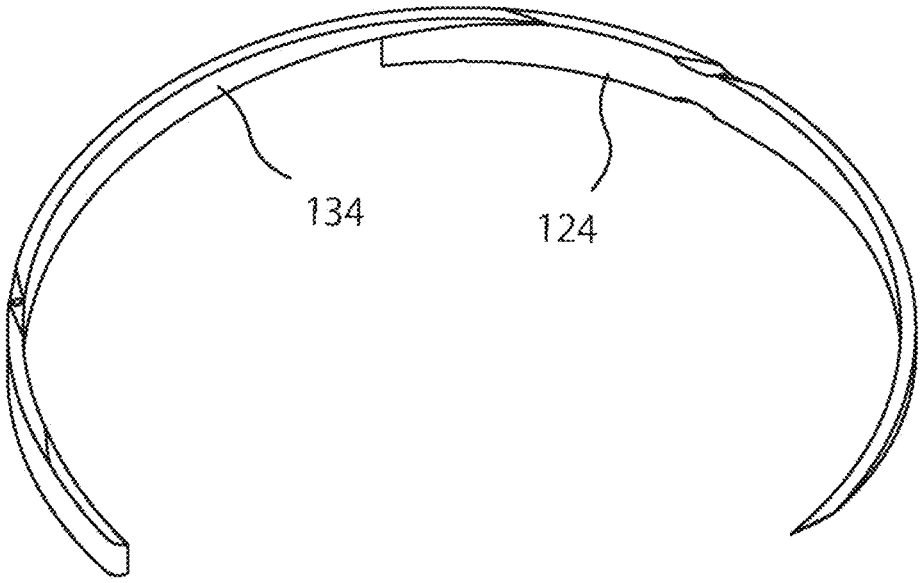
FIG. 21C is a perspective view of the pedestal portions viewed from a different direction from FIG. 21A.

FIG. 20A is a perspective view of the first blade 120 and the second blade 130 that constitute a rotor blade according to a ninth embodiment of the present invention. FIG. 20B is a front view of the first blade 120 and the second blade 130 that constitute the rotor blade according to the ninth embodiment of the present invention. FIG. 21A is a perspective view of the pedestal portions 124, 134 illustrated in FIG. 20A. FIG. 21B is a front view of the pedestal portions 124, 134 illustrated in FIG. 20A. FIG. 21C is a perspective view of the pedestal portions 124, 134 viewed from a different direction from FIG. 21A.

In the sixth to eighth embodiments, a pedestal portion is disposed in each blade, and the pedestal portions are not directly connected to one another. In the ninth embodiment, the pedestal portion 124 in the first blade 120 and the pedestal portion 134 in the second blade 130 are connected and continuous. This further enhances rigidity.

Specifically, the extended portion 123 of the first blade 120 and an extended portion 133 of the second blade 130 each extend around the rotation axis (around a circumference) of a hub. The pedestal portion 124 is disposed on the extended portion 123 of the first blade 120, and the pedestal portion 134 is disposed not only on the extended portion 133 of the second blade 130 but also on a part of a distal end portion of the pedestal portion 124 in the first blade 120. As a part on which the pedestal portion 134 is placed, the distal end portion of the pedestal portion 124 in the first blade 120 has a short length in the rotation axis direction of the hub. The end (lower end, rear end) 124*b* on the opposite-direction side of the pedestal portion 124 does not shift with respect to the rotation axis of the hub as a whole. However, the length of the distal end portion in the pedestal portion 124 from the end (lower end, rear end) 124*b* on the opposite-direction side to the end (upper end, front end) 124*a* on the one direction side is gradually shortened toward the distal end. For these reasons, a blade main body portion and the pedestal portion 124 in the first blade 120 and a blade main body portion and an exposed end (upper end, front end) on the one-direction side of the pedestal portion 134 in the second blade 130 are on the same plane (a surface perpendicular to the rotation axis of the hub).

As connection positions to reinforcing portions, connection positions P11 to P17 are disposed on an end (upper end, front end) on the one direction side of the first blade 120 sequentially from the rotation axis side of the hub toward an outward curvature direction. As connection positions to reinforcing portions, connection positions P21 to P27 are disposed on an end (upper end, front end) on the one-direction side of the second blade 130 sequentially from the rotational axis side of the hub toward the outward curvature direction.

One reinforcing portion (not illustrated in FIG. 20A) is connected from a side of the hub (not illustrated) to the ends (upper ends, front ends) on the one-direction side of the first blade 120 and the second blade 130 at the connection positions P22, P13, P25, and P16 in this order. Another reinforcing portion (not illustrated in FIG. 20A) is connected at the connection positions P11, P23, P14, P26, and P17 in this order.

In the first blade 120 configured to include a connecting portion, the blade main body portion, and the extended portion 123, since the pedestal portion 124 is attached to an end (upper end, front end) on the one-direction side of the extended portion 123, not only the connection positions P11, P23, P14, and P26 but also the connection position P17 do not shift in position in the rotation axis direction of the hub. Therefore, the reinforcing portion can also be attached to the distal end portion of the first blade 120 on the same plane (the surface perpendicular to the rotation axis of the hub).

Yet another reinforcing portion (not illustrated in FIG. 20A) is connected at the connection positions P21, P12, P24, P15, and P27 in this order. In the second blade 130 configured to include a connecting portion, the blade main body portion, and the extended portion 133, since the pedestal portion 134 is attached to an end (upper end, front end) on the one direction side of the extended portion 133, not only the connection positions P21, P12, P24, and P15 but also the connection position P27 do not shift in position in the rotation axis direction of the hub. Therefore, the reinforcing portion can also be attached to the distal end portion of the second blade 130 on the same plane (the surface perpendicular to the rotation axis of the hub).

Connection positions to reinforcing portions are also disposed on ends (lower ends, rear ends) on the opposite-direction side of the first blade 120 and the second blade 130, and the reinforcing portions are connected between them.

In the ninth embodiment, the ends (lower ends, rear ends) on the opposite-direction side of the connecting portion, the blade main body portion, and the extended portion 123 constituting the first blade 120 do not shift in position in the rotation axis direction of the hub. Therefore, the reinforcing portions can also be attached to the extended portion 123 of the first blade 120 on the same plane. The ends (lower ends, rear ends) on the opposite-direction side of the connecting portion, the blade main body portion, and the extended portion 133 constituting the second blade 130 do not shift in position in the rotation axis direction of the hub. Therefore, the reinforcing portions can also be attached to the extended portion 133 of the second blade 130 on the same plane. This can be achieved in the same way even when the pedestal portions are disposed on the ends (lower ends, rear ends) on the opposite direction side.

The pedestal portions 124, 134 may be in a form where they are disposed on the end (upper end, front end) in one direction of the extended portion 123 as illustrated, may be in a form where they are disposed on the end (lower end, rear end) in the opposite direction of the extended portion 123, or may be in a form where they are disposed on the end (upper end, front end) in one direction of the extended portion 123 and on the end (lower end, rear end) in the opposite direction of the extended portion 123.

Tenth Embodiment

Figure 22:
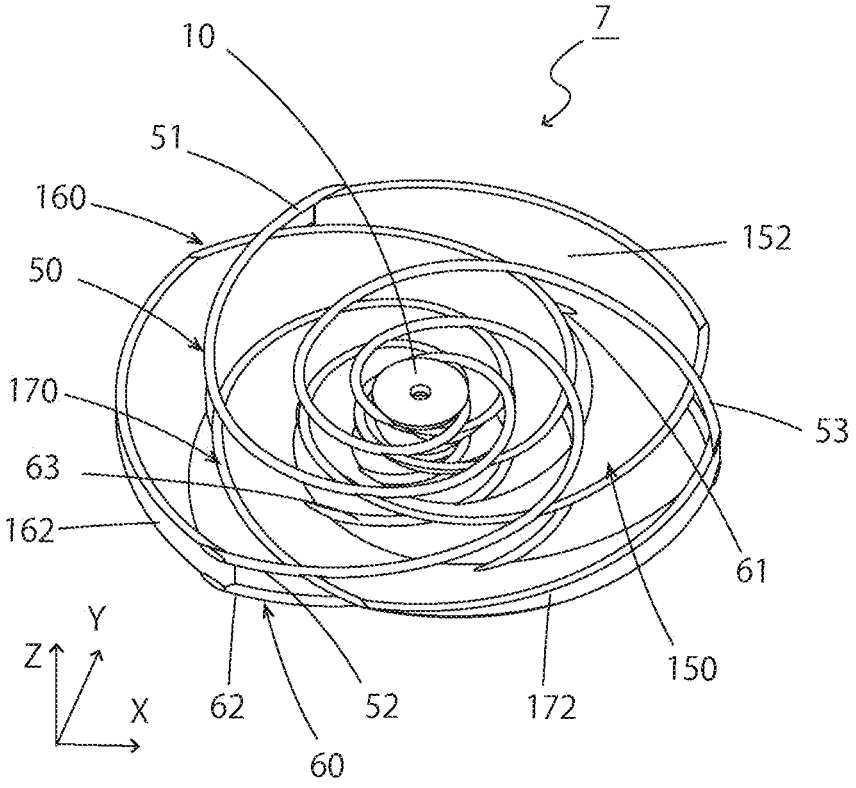
FIG. 22 is a perspective view of a rotor blade according to a tenth embodiment of the present invention.

FIG. 22 illustrates a perspective view of a rotor blade 7 according to a tenth embodiment of the present invention. The rotor blade 7 according to the tenth embodiment of the present invention is configured to include the hub 10, a first blade 150, a second blade 160, and a third blade 170 as a plurality of blades, the reinforcing portions 50, and the reinforcing portions 60. The hub 10 is similar to the one described in the first embodiment. It is similar to the first embodiment in that the reinforcing portions 50 are disposed on the ends, in one direction of the rotation axis, of the plurality of blades, and the reinforcing portions 60 are disposed on the ends, in the opposite direction of the rotation axis, of the plurality of blades.

While the plurality of blades are constituted of three blades of the first blade 150, the second blade 160, and the third blade 170 as illustrated in FIG. 22, the number of blades may be two, four, or others.

As illustrated in FIG. 22, the first blade 150 as one blade constituting the rotor blade 7 in FIG. 22 has one end connected to the hub 10 and is disposed to be curved around the hub 10. The first blade 150 is configured as a unit by including a connecting portion and a blade main body portion 152. An end on the one-direction side (+Z-axis direction side) or an end on the opposite-direction side (−Z-axis direction side) of the blade main body portion 152 is formed into any of a logarithmic spiral pattern, a Fibonacci spiral pattern, a Fermat's spiral pattern, a conical spiral pattern, or a hyperbolic spiral pattern, with the hub 10 at the center when viewed from the one-direction side. Moreover, in the blade main body portion 152, a width parallel to the rotation axis of the hub 10 is uniform around the hub 10. That is, when viewed from the one-direction side of the blade main body portion 152, the end on the one-direction side (+Z-axis direction side) of the blade main body portion 152 does not change around the hub 10, and the end on the opposite-direction side (−Z-axis direction side) of the blade main body portion 152 does not change around the hub 10. That is, respective ends of the blade main body portions 152 do not shift in the Z-axis direction around the hub 10.

Therefore, when the respective reinforcing portions of the reinforcing portions 50 are disposed on the ends (upper ends, front ends), on the one-direction side of the rotation axis, of the plurality of blades, distal ends of the reinforcing portions 51, 52, 53 can be mounted on the distal end sides of the blade main body portions 152 as illustrated in FIG. 22.

When the respective reinforcing portions of the reinforcing portions 60 are disposed on the ends (lower ends, rear ends), on the opposite-direction side of the rotation axis, of the plurality of blades, distal ends of the reinforcing portions 61, 62, 63 can be attached on the distal end sides of the blade main body portions 152 as illustrated in FIG. 22.

In FIG. 22, the reinforcing portions 51, 52, 53 have the same turning direction viewed from the one-direction side as the reinforcing portions 61, 62, 63, and both are counterclockwise rotation when viewed from the +Z-direction. The turning direction viewed from the one-direction side of the reinforcing portions 51, 52, 53 may be opposite to the one of the reinforcing portions 61, 62, 63. It is similar to the first embodiment in that the reinforcing portions 60 are disposed on the ends, in the opposite direction of the rotation axis, of the plurality of blades.

In FIGS. 3A to 3D illustrating the first embodiment and FIGS. 13A to 21C illustrating the sixth to ninth embodiments, the reinforcing portions can be attached by providing recesses on the end (upper end, front end) in one direction and the end (lower end, rear end) in the opposite direction of each blade. Conversely, in the reinforcing portions, processing of recesses and projections or the like may be provided at connection positions corresponding to connection portions of the respective blades such that the recesses and projections are engaged, and the recesses and projections of the reinforcing portions may be used to connect to the blades.

Other Embodiments

The embodiments of the present invention are not limited to those described above and may be changed as necessary upon application within the scope of the present invention.

As in the rotor blade 2 according to the second embodiment of the present invention, the curvature of each reinforcing portion of the second reinforcing group 70 is made smaller than that of each reinforcing portion of the first reinforcing group 50, which may be applied to the third embodiment or the fourth embodiment.

Instead of disposing the ring portion 80 on the +Z-side of a plurality of blades as in the rotor blade 3 according to the third embodiment of the present invention, a ring portion may be disposed on the −Z-side of a plurality of blades. On the side where the ring portion is not disposed, a reinforcing group is disposed.

Instead of disposing the ring portion 95 and the first reinforcing group 90 on the +Z-side of a plurality of blades as in the rotor blade 4 according to the fourth embodiment of the present invention, a ring portion and a first reinforcing group connected to the ring portion may be disposed on the −Z-side of a plurality of blades. On the side where the ring portion is not disposed, another reinforcing group is disposed.

Without limiting to a case where a reinforcing group constituted of reinforcing portions having straight line shapes are disposed on the +Z-side of a plurality of blades as in the rotor blade 5 according to the fifth embodiment of the present invention, a reinforcing group constituted of reinforcing portions having straight line shapes may be disposed on the −Z-side of a plurality of blades. In addition, reinforcing portions having straight line shapes may be disposed as a first reinforcing group on the +Z-side of a plurality of blades, and reinforcing portions having straight line shapes may be disposed as a second reinforcing group on the −Z-side of the plurality of blades. At that time, the reinforcing portions may be disposed extending across from the hub 10 to the blade farthest from the hub 10, or a reinforcing portion having straight line shapes may be disposed in at least one or a plurality of areas between blades adjacent to one another in the radial direction.

In each of the embodiments described above, each reinforcing portion does not need to be formed only with a curved part, as illustrated. Each reinforcing portion may have a part formed in a straight line or may have a whole formed in a straight line to have a bending straight line shape in which it bends each time it is connected to each blade.

Each reinforcing portion may have a circular, oval, triangular, quadrangular, or other polygonal cross-sectional surface, and a reinforcing portion may have a hollow tubular shape.

Each reinforcing portion may be connected to blades not only by bonding with adhesive but also by bonding, welding, using fasteners such as screws, or another method.

A ring portion is not limited only to being in a circular, oval, or quadrangular shape, but it is only necessary to be in an endless shape.

In the first to fifth embodiments, at least any of a plurality of reinforcing portions (reinforcing group) and a ring portion are disposed on both the +Z-side and the −Z-side of a plurality of blades but may be disposed only on the +Z-side or only on the −Z-side.

In the first to fifth embodiments, some reinforcing portions are connected to all of the first blade 20, the second blade 30, and the third blade 40. However, they may be connected only between two specific blades adjacent to one another in the radial direction from a hub.

Figure 10:
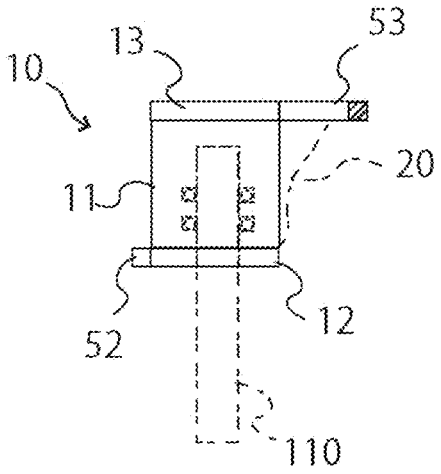
FIG. 10 is a partial cross-sectional view along the line A-A in FIG. 2A.

Various connections are considered for the connection of the first blade 20, the second blade 30, and the third blade 40 as a plurality of blades with respect to each reinforcing portion. An exemplary partial cross-sectional view along the line A-A in FIG. 2A is illustrated in FIG. 10 and described. The hub 10 has a hub main body portion 11, and blades (only the first blade 20 is illustrated in FIG. 10) are connected to a side surface of the hub main body portion 11. A rotation shaft 110 is inserted into and coupled to the hub main body portion 11. This diagram illustrates an inner roller type in which a drive motor and a power generation motor are disposed to be joined to the rotation shaft 110. This, however, should not be construed in a limiting sense, and an outer roller type may be used. A connecting portion 13 connected to the third reinforcing portion 53 is disposed in the +Z-direction of the hub main body portion 11, and a connecting portion 12 connected to the second reinforcing portion 52 is disposed in the −Z-direction of the hub main body portion 11. The connecting portion 12 and the connecting portion 13 are connected to the hub main body portion 11 with the hub main body portion 11 interposed therebetween.

As illustrated in FIG. 10, in the hub 10, the connecting portion 12 may be integrally molded with reinforcing portions, such as the second reinforcing portion 52, the connecting portion 13 may be integrally molded with reinforcing portions, such as the third reinforcing portion 53, and the respective integrally molded components may be connected to the hub main body portion 11. The hub 10 may be configured by joining each of the reinforcing portions, such as the second reinforcing portion 52, to the connecting portion 12 with fasteners such as screws, joining each of the reinforcing portions, such as the third reinforcing portion 53, to the connecting portion 13 with fasteners such as screws, and joining the connecting portion 12 and the connecting portion 13 to the hub main body portion 11. The hub 10 may be configured by connecting each of the reinforcing portions, such as the second reinforcing portion 52 and the third reinforcing portion 53, one by one to the hub main body portion 11. Various methods such as bonding, welding, and screw fastening are employed for connecting or joining the reinforcing portions, such as the second reinforcing portion 52 and the third reinforcing portion 53.

For connecting or joining the first blade 20, the second blade 30, and the third blade 40 as a plurality of blades to the hub main body portion 11, various methods such as bonding, welding, and screw fastening are also employed. The first blade 20, the second blade 30, and the third blade 40 as a plurality of blades may be integrally molded with a part or a whole of the hub main body portion 11.

The connection or joining between the hub 10 and the reinforcing portions, such as the second reinforcing portion 52 and the third reinforcing portion 53, is only an example, and another form may be used. For the connection or joining of the reinforcing portions, such as the second reinforcing portion 52 and the third reinforcing portion 53, to the first blade 20, the second blade 30, and the third blade 40 as a plurality of blades, as illustrated in FIG. 10, the reinforcing portions are linear, and the first blade 20, the second blade 30, and the third blade 40 as a plurality of blades have short dimensions in the Z-axis direction. As illustrated in FIG. 10, when the reinforcing portions, such as the second reinforcing portion 52 and the third reinforcing portion 53, are connected to any of the upper ends and the lower ends of the first blade 20, the second blade 30, and the third blade 40 as a plurality of blades, most parts of the reinforcing portions may be exposed from the blades, parts of the reinforcing portions may be exposed from the blades, or further, parts of the reinforcing portions may project from the first blade 20, the second blade 30, and the third blade 40 as a plurality of blades. In addition, all of the reinforcing portions, such as the second reinforcing portion 52 and the third reinforcing portion 53, may be embedded in on any of the upper end sides or the lower end sides of the first blade 20, the second blade 30, and the third blade 40 as a plurality of blades, and the reinforcing portions need not be exposed.

Figure 11:
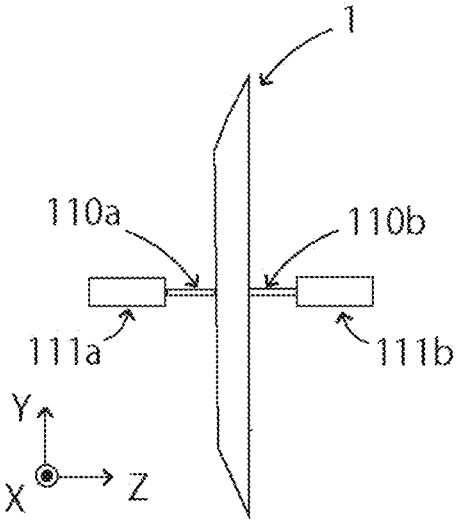
FIG. 11 is a schematic diagram illustrating a relationship between the rotor blade and a power generation motor or drive motor.

In the form illustrated in FIG. 10, the rotation shaft 110 is inserted from the −Z-direction of the hub main body portion 11, and necessary parts, such as a regulator and an oscillating mechanism, including a power generation motor and a drive motor, are disposed in the rotation shaft 110. FIG. 11 schematically illustrates a relationship between the rotor blade 1 and parts 111*a*, 111*b*, such as a power generation motor or drive motor. Rotation shafts 110*a*, 110*b* of the rotor blade 1 may be disposed to extend from the rotor blade 1 in the +Z-direction or may be disposed to extend from the rotor blade 1 in the −Z-direction. The parts 111*a*, 111*b*, such as a power generation motor or drive motor, are attached on an opposite side across the rotor blade 1 from the rotation shafts 110*a*, 110*b*. Only any one of the rotation shaft 110*a* with the part 111*a* and the rotation shaft 110*b* with the part 111*b* may be disposed, or both may be disposed. When both are disposed, the rotation of the rotation shaft 110*a* and the rotation of the rotation shaft 110*b* are devised such that they are coordinated. This can be applied to the rotor blades 2, 3, 4, 5, and other rotor blades.

As illustrated in FIGS. 9A and 9B and other drawings, the rotor blades 1, 2, 3, 4, and 5 are illustrated such that the first blade 20, the second blade 30, and the third blade 40 as a plurality of blades, are constituted of curved plates. However, the plurality of blades are configured to have thicknesses adjusted according to portions of angles from the radial direction of the plurality of blades and the X-axis direction around the hub such that fluid such as air and water is divided by each of the plurality of blades to allow fluid such as wind to generate lift around each of the plurality of blades. This is mentioned in Patent Documents 1 to 3 described above, and therefore, the explanation is omitted.

In the blades in which the pedestal portions are disposed on the extended portions as in the sixth embodiment to the ninth embodiment, the blades are curved, and the pedestal portions are disposed at the portions of the extended portions most distant from the rotation axis of the hub, thereby avoiding fluid leaving outside a turning radius as much as possible and allowing it to flow rearward.

In the matter described in the other embodiments and any form of the first, second, fourth, and fifth embodiments, the extended portions may be disposed to be adjacent to the blade main body portions, and the pedestal portions may be disposed on the extended portions, as in the sixth embodiment to the ninth embodiment.

Figure 23:
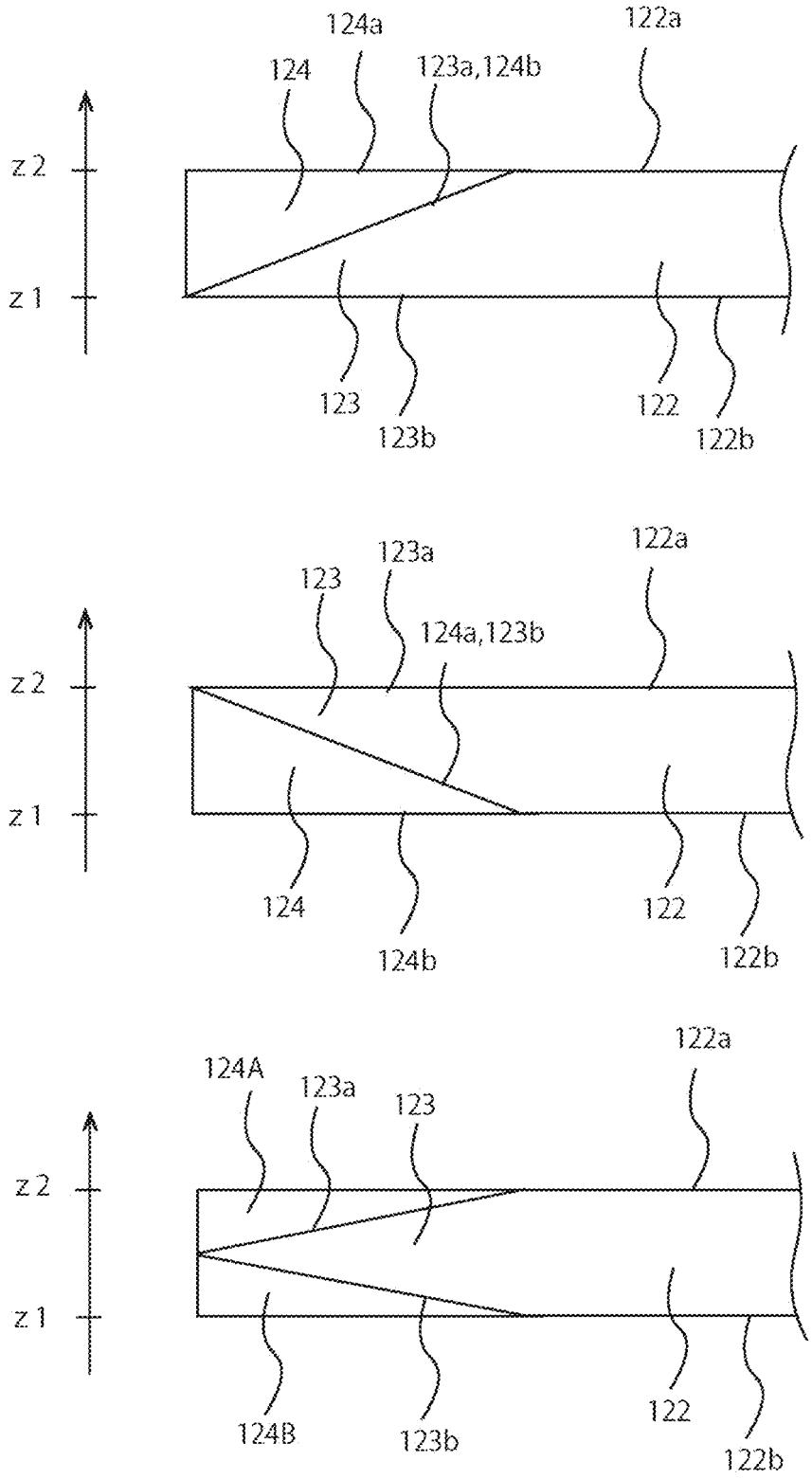
FIG. 23 is a diagram schematically illustrating a state in which the first blade that can be disposed by being curved around a rotation axis of a hub is virtually stretched to a flat shape.

FIG. 23 schematically illustrates a state in which the first blade that can be disposed by being curved around the rotation axis of a hub is virtually stretched to a flat shape. As illustrated in the upper stage of FIG. 23, in the sixth embodiment, the blade main body portion 122 of the first blade 120 has an approximately uniform width from z1 to z2. While the end 123*b* on the −Z-side of the extended portion 123 lies at z1, the end 123*a* on the +Z-side is gradually reduced by the angle formed with the hub. The pedestal portion 124 is attached to the end 123*a* on the +Z-side of the extended portion 123, and the end 124*a* on the +Z-side of the pedestal portion 124 lies at z2.

As illustrated in the middle stage of FIG. 23, the blade main body portion 122 of the first blade 120 has an approximately uniform width from z1 to z2. While the end 123*a* on the +Z-side of the extended portion 123 lies at z2, the end 123*b* on the −Z-side is gradually increased by the angle formed with the hub. The pedestal portion 124 is attached to the end 123*b* on the −Z-side of the extended portion 123, and the end 124*b* on the −Z-side of the pedestal portion 124 lies at z1.

As illustrated in the lower stage of FIG. 23, the blade main body portion 122 of the first blade 120 has an approximately uniform width from z1 to z2. The end 123*a* on the +Z-side of the extended portion 123 is gradually reduced by the angle formed with the hub. The end 123*b* on the −Z-side is gradually increased by the angle formed with the hub. A pedestal portion 124A is attached to the end 123*a* on the +Z-side of the extended portion 123, and an end on the +Z-side of the pedestal portion 124A lies at z2. A pedestal portion 124B is attached to the end 123*b* on the −Z-side of the extended portion 123, and an end on the −Z-side of the pedestal portion 124B lies at z1. The pedestal portion 124A and the pedestal portion 124B may be a unit. Distal ends of the pedestal portion 124A and the pedestal portion 124B may extend on the distal end side with respect to the distal end of the extended portion 123.

INDUSTRIAL APPLICABILITY

The rotary blade according to the present invention can be used as a propeller for wind power generation, a turbine for hydroelectric power generation, and a turbine for steam power generation. It can also be used, by connecting to drive motors and so on, in blower fans, propellers of aircraft, helicopters, multicopters, and the like, screws of boats, ships and the like, propellers of pumps and the like, and various apparatuses that send fluid.

REFERENCE SIGNS LIST

1, 2, 3, 4, 5, 6, 7: Rotor blade
10: Hub
20, 120, 150: First blade
21, 121, 151: Connecting portion
22, 122, 132, 152: Blade main body portion
22*a*: Upper end (front end) of blade main body portion
22*b*: Lower end (rear end) of blade main body portion
23: Distal end portion
23*a*: Upper end (front end) of distal end portion
23*b*: Lower end (rear end) of distal end portion
30, 130: Second blade
40, 140: Third blade
50, 90: First reinforcing group (reinforcing portions)
51, 61, 71, 101: First reinforcing portion
52, 62, 72, 102: Second reinforcing portion
53, 63, 73, 103: Third reinforcing portion
60, 70: Second reinforcing group (reinforcing portions)
74, 105: Fourth reinforcing portion
75, 106: Fifth reinforcing portion
76, 107, 107*a*: Sixth reinforcing portion
80, 95: Ring portion
123, 133: Extended portion
124, 134, 144: Pedestal portion

The invention claimed is:

1. A rotor comprising:
a hub on a rotation axis of the rotor;
a plurality of blades each connected to and curved around the hub; and
a plurality of reinforcing portions each curved around the hub and connected to at least one of a front edge portion and a rear edge portion of the blades adjacent to one another in at least a radial direction, wherein
each of the blades includes:
a blade main body portion, the blade main body portion having any one of a front edge or a rear edge, the one edge formed into any of a logarithmic spiral pattern, a Fibonacci spiral pattern, a Fermat's spiral pattern, a conical spiral pattern, or a hyperbolic spiral pattern, around the hub,
an extended portion connected to the blade main body portion and having different widths when viewed from a direction perpendicular to the rotation axis, and
a pedestal portion on one edge of the extended portion that contacts at least any of the front edge or the rear edge, and
at least one of the reinforcing portions is connected to one part of the pedestal portion of one of the blades, said one part being farthest from the hub among the other parts of the pedestal portion.

2. The rotor according to claim 1, wherein
each of the blades is curved in a first direction, and each of the reinforcing portions is curved in a second direction that is opposite to the first direction.

3. The rotor according to claim 1, wherein
each of the reinforcing portions is connected to all of the blades.

4. The rotor according to claim 1, wherein
one end of each of the reinforcing portions is connected to the hub.

5. The rotor according to claim 1, wherein
said at least one of the reinforcing portions is further connected to the blade main body portion of another of the blades on a plane that is perpendicular to the rotation axis and passes through a connection point between said at least one of the reinforcing portions and said one part of the pedestal portion.

6. The rotor according to claim 1, wherein
the blades include first and second blades each including:
the blade main body portion, and
the extended portion, wherein
the first blade has a first pedestal portion, the second blade has a second pedestal portion, and the second pedestal portion is provided on the side where the first pedestal portion is provided, the first pedestal portion is joined to the second pedestal portion, the reinforcing portions include first and second reinforcing portions, and the first reinforcing portion is connected to one part of the first pedestal portion that is farthest from the hub among the other parts of the first pedestal portion, and the second reinforcing portion is connected to one part of the second pedestal portion that is farthest from the hub among the other parts of the second pedestal portion.

7. The rotor according to claim 1, wherein a total number of the blades is two, three, or four.

8. An apparatus comprising:

the rotor according to claim 1; and a motor including either a power generation motor or a drive motor.

* * * * *